US007119824B2

(12) United States Patent
Ishibe

(10) Patent No.: US 7,119,824 B2
(45) Date of Patent: Oct. 10, 2006

(54) MULTI-BEAM OPTICAL SCANNING APPARATUS, AND IMAGE FORMING APPARATUS USING THE SAME

(75) Inventor: Yoshihiro Ishibe, Tochigi (JP)

(73) Assignee: Canon Kabushiki Kaisha, Tokyo (JP)

( * ) Notice: Subject to any disclaimer, the term of this patent is extended or adjusted under 35 U.S.C. 154(b) by 364 days.

(21) Appl. No.: 10/809,445

(22) Filed: Mar. 26, 2004

(65) Prior Publication Data

US 2005/0052525 A1 Mar. 10, 2005

(30) Foreign Application Priority Data

Sep. 4, 2003 (JP) ..... 2003-312843
Mar. 9, 2004 (JP) ..... 2004-065790

(51) Int. Cl.
*B41J 2/435* (2006.01)

(52) U.S. Cl. ..... 347/235; 347/250

(58) Field of Classification Search ..... 347/233–235, 347/241, 243, 248–250, 244, 256, 258–261; 359/204–207, 216–217
See application file for complete search history.

(56) References Cited

U.S. PATENT DOCUMENTS

| | | | | |
|---|---|---|---|---|
| 5,859,720 | A | 1/1999 | Ishibe | 359/196 |
| 5,995,131 | A | 11/1999 | Fujibayashi et al. | 347/258 |
| 6,067,106 | A | 5/2000 | Ishibe et al. | 347/258 |
| 6,133,935 | A | 10/2000 | Fujibayashi et al. | 347/258 |
| 6,256,132 | B1 | 7/2001 | Ishibe | 359/204 |
| 6,317,244 | B1 | 11/2001 | Ishibe | 359/204 |
| 6,362,470 | B1 | 3/2002 | Yoshida et al. | 250/235 |
| 6,489,982 | B1 | 12/2002 | Ishibe | 347/134 |
| 2002/0063910 | A1 | 5/2002 | Ishibe | 358/514 |
| 2002/0163703 | A1 | 11/2002 | Ishibe | 359/204 |
| 2003/0001944 | A1 | 1/2003 | Yoshida et al. | 347/241 |
| 2003/0156183 | A1* | 8/2003 | Ishihara | 347/234 |
| 2004/0189789 | A1 | 9/2004 | Ishibe | 347/243 |

FOREIGN PATENT DOCUMENTS

| | | |
|---|---|---|
| JP | 5-333281 | 12/1993 |
| JP | 9-197308 | 7/1997 |

* cited by examiner

*Primary Examiner*—Hai Pham
(74) *Attorney, Agent, or Firm*—Fitzpatrick, Cella, Harper & Scinto

(57) ABSTRACT

An object is to obtain a multi-beam optical scanning apparatus in which a displacement of an image location of each of light beams emitted from a plurality of light emitting portions is reduced, and which is suitably usable in a high-speed and high-image-quality application, and an image forming apparatus using the multi-beam optical scanning apparatus.

A multi-beam optical scanning apparatus includes a light source unit 1 having plural light emitting portions disposed with being spaced from each other in a main-scanning direction, a first optical system 2 for changing conditions of plural divergent light beams emitted from the light source unit, a stop 3 for restricting widths of the plural light beams transmitted through the first optical system, a deflecting unit 5 for reflecting the plural light beams restricted by the stop, a second optical system 6 for forming images of the plural light beams reflected by the deflecting unit on a surface 7 to be scanned, and a detecting unit for detecting a writing start position synchronous signal for controlling a timing of a scanning start position on the surface to be scanned. The individual elements are designed so as to satisfy a predetermined condition.

22 Claims, 23 Drawing Sheets

FIG. 8

| | IMAGE HEIGHT | $\beta$ | tan ( $\beta$ ) | $\delta$ M ( $\beta$ ) |
|---|---|---|---|---|
| BD IMAGE HEIGHT | 114.1 | 28.77910 | 0.54928 | 0.99047 |
| EFFECTIVE SCANNING END PORTION | 107.0 | 27.52186 | 0.52105 | 0.59029 |
| | 100.0 | 26.39717 | 0.49634 | 0.80363 |
| | 90.0 | 24.63632 | 0.45860 | 0.68853 |
| | 80.0 | 22.63971 | 0.41707 | 0.64509 |
| | 70.0 | 20.41161 | 0.37213 | 0.57634 |
| | 60.0 | 17.96705 | 0.32428 | 0.51706 |
| | 50.0 | 15.32079 | 0.27396 | 0.59464 |
| | 40.0 | 12.49762 | 0.22165 | 0.68772 |
| | 30.0 | 9.53238 | 0.16792 | 0.74905 |
| | 20.0 | 6.46262 | 0.11327 | 0.83248 |
| | 10.0 | 3.32387 | 0.05808 | 0.91093 |
| | 0.0 | 0.14897 | 0.00260 | 0.90295 |
| | -10.0 | -3.03099 | -0.05295 | 0.82136 |
| | -20.0 | -6.18621 | -0.10839 | 0.79833 |
| | -30.0 | -9.28701 | -0.16352 | 0.90100 |
| | -40.0 | -12.30174 | -0.21807 | 1.02527 |
| | -50.0 | -15.19655 | -0.27163 | 1.00502 |
| | -60.0 | -17.94007 | -0.32376 | 0.87183 |
| | -70.0 | -20.50927 | -0.37407 | 0.79034 |
| | -80.0 | -22.88949 | -0.42220 | 0.72092 |
| | -90.0 | -25.06569 | -0.46770 | 0.55486 |
| | -100.0 | -27.02814 | -0.51014 | 0.48505 |
| EFFECTIVE SCANNING END PORTION | -107.0 | -28.29328 | -0.53829 | 0.49679 |

FIG. 15

| | IMAGE HEIGHT | $\beta$ | tan ( $\beta$ ) | $\delta$ M ( $\beta$ ) |
|---|---|---|---|---|
| EFFECTIVE SCANNING END PORTION | 107.0 | 34.93362 | 0.69848 | 0.68087 |
| | 100.0 | 33.61331 | 0.66473 | 0.09951 |
| | 90.0 | 31.44978 | 0.61160 | 0.36995 |
| | 80.0 | 29.04196 | 0.55527 | 0.10995 |
| | 70.0 | 26.37108 | 0.49578 | 0.69631 |
| | 60.0 | 23.37510 | 0.43222 | 0.62936 |
| | 50.0 | 20.03816 | 0.36472 | 0.18099 |
| | 40.0 | 16.38689 | 0.29407 | 0.39433 |
| | 30.0 | 12.48289 | 0.22138 | 0.83714 |
| | 20.0 | 8.40556 | 0.14777 | 0.93216 |
| | 10.0 | 4.22665 | 0.07390 | 0.76345 |
| | 0.0 | 0.00000 | 0.00000 | 0.65924 |
| | -10.0 | -4.23262 | -0.07401 | 0.73708 |
| | -20.0 | -8.42855 | -0.14818 | 0.88715 |
| | -30.0 | -12.53348 | -0.22231 | 0.86244 |
| | -40.0 | -16.47721 | -0.29578 | 0.54114 |
| | -50.0 | -20.18326 | -0.36760 | 0.31214 |
| | -60.0 | -23.59199 | -0.43672 | 0.58860 |
| | -70.0 | -26.67820 | -0.50247 | 0.65970 |
| | -80.0 | -29.45567 | -0.56475 | 0.16849 |
| | -90.0 | -31.97472 | -0.62426 | 0.30462 |
| | -100.0 | -34.25236 | -0.68094 | 0.05607 |
| EFFECTIVE SCANNING END PORTION | -107.0 | -35.65104 | -0.71728 | 0.38300 |

MULTI-BEAM OPTICAL SCANNING APPARATUS, AND IMAGE FORMING APPARATUS USING THE SAME

BACKGROUND OF THE INVENTION

1. Field of the Invention

The present invention relates to a multi-beam optical scanning apparatus and an image forming apparatus using the same, and particularly to a multi-beam optical scanning apparatus which is suitably usable in an image forming apparatus, such as a laser beam printer, a digital copying machine, and a multi-function printer that employ the electrophotographic process, for example, and can achieve operation with high speed and high recording density by using a light source unit having a plurality of light emitting or radiation portions.

2. Related Background Art

FIG. 23 is a cross-sectional view taken along a main-scanning direction and schematically illustrating a main portion of a conventional multi-beam optical scanning apparatus.

In FIG. 23, plural light beams emitted, for example, from a multi-beam semiconductor laser 91 with plural light emitting portions (light emitting points) are converted into approximately parallel light beams or convergent light beams by a collimator lens 92, and are incident on a cylindrical lens 94 after sizes of cross sections of these light beams are restricted by an aperture stop 93. Each light beam incident on the cylindrical lens 94 emerges therefrom without any change in a main-scanning section. With respect to a sub-scanning section, each light beam is converged by the cylindrical lens 94, and is imaged on a place close to a deflecting facet 95*a* of a polygon mirror 95 serving as a deflecting unit, as a linearly-focused image extending in the main-scanning direction. Each light beam is reflectively deflected and scanned by the deflecting facet 95*a* of the polygon mirror 95 rotating at a uniform angular speed in a direction of an arrow A in FIG. 23, and is imaged on a surface 97 to be scanned (a scanned surface) of a photosensitive drum or the like in the form of a spot by a fθ lens 96. The scanned surface 97 is scanned with the imaged spot moving at a uniform speed in a direction of an arrow B in FIG. 23. Thus, image recording is executed on the photosensitive drum surface 97 serving as a recording medium.

In such a multi-beam optical scanning apparatus, a unit for detecting a writing start position synchronous signal immediately before writing of an image signal is usually arranged to accurately control the writing start position of an image on the scanned surface.

In FIG. 23, reference numeral 78 designates a folding mirror (a BD mirror) which reflects a light beam (a BD light beam) for detection of the writing start position synchronous signal toward the side of a BD sensor 81 described later, so that a timing of a scanning start position on the photosensitive drum surface 97 can be detected. Reference numeral 79 designates a slit member (a BD slit) which is disposed at a position optically equivalent to the photosensitive drum surface 97. Reference numeral 80 designates a BD lens which serves to establish an optical conjugate relationship between the BD mirror 78 and the BD sensor 81, and compensates for a fall or inclination of the BD mirror 78. Reference numeral 81 designates an optical sensor (the BD sensor) which acts as a device for detecting the writing start position synchronous signal. Here, elements of the BD mirror 78, the BD slit 79, the BD lens 80, the BD sensor 81 and the like constitute a portion of the detecting unit (a BD optical system) for detecting the writing start position synchronous signal. In the apparatus of FIG. 23, the timing of the writing start position for image recording on the photosensitive drum surface 97 is adjusted by detecting an output signal from the BD sensor 81.

In such a multi-beam optical scanning apparatus, in the event that plural light emitting portions A and B (although two light emitting portions A and B are illustrated in FIG. 24 for the convenience of easy understanding, three or more than three light emitting portions can be similarly arranged) are arranged in a vertical direction along the sub-scanning direction as illustrated in FIG. 24, a spacing between scanning lines formed by light beams from these light emitting portions in the sub-scanning direction on the scanned surface is likely to be much larger than a spacing of a desired recording density. Accordingly, those plural light emitting portions A and B are normally arranged along a direction oblique to the main-scanning direction as illustrated in FIG. 25, and its oblique angle δ is controlled such that the spacing between the scanning lines in the sub-scanning direction on the scanned surface can be accurately adjusted in conformity with the recording density.

In the above-discussed conventional multi-beam optical scanning apparatus, since the plural light emitting portions A and B are arranged obliquely relative to the main-scanning direction, light beams emitted from the light emitting portions A and B reach different locations spaced from each other in the main-scanning direction on the deflecting facet 95*a* of the polygon mirror 95 as illustrated in FIG. 26, respectively, and traveling angles of the light beams reflected by the deflecting facet 95*a* of the polygon mirror 95 are also different from each other. Hence, light spots are imaged on different locations spaced in the main-scanning direction on the scanned surface 97, respectively (see a light beam A and a light beam B).

In such a multi-beam optical scanning apparatus, therefore, the image signal is supplied with a timing shift of a predetermined time δT such that an image location of a light beam emitted from a certain reference light emitting portion on the scanned surface can coincide with an image location of a light beam emitted from another light emitting portion.

The deflecting facet is designed at an angle indicated by 95*a*' in FIG. 26 when the timing shifts by δT, and accordingly a light beam at this moment is reflected in a direction B', i.e., reflected in the same direction (at the same angle) as that of the light beam A, leading to coincidence of the image locations of spots formed by these light beams.

In such a construction, however, the image locations of those light beams are likely to deviate from each other in the main-scanning direction in the event that a main-scanning focus variation or focus displacement (a focus displacement in an optical axial direction of the fθ lens 96) occurs for some reasons, for example, due to a positional displacement between an optical unit for holding the optical system and the scanned surface, an assemblage error at the time when an optical component is assembled in the optical unit, or the like. For example, provided that the scanned surface 97 was displaced from a regular position to a position indicated by 97' in FIG. 26, the image locations of the light beams deviate from each other by $\delta Y_1$ in the main-scanning direction as can be seen from FIG. 26.

Thus, problems of a decrease in printing precision and degradation of an image quality are conventionally present due to such occurrence of the displacement $\delta Y_1$ in the main-scanning direction between the image locations of the light beams emitted from the light sources (the light source unit having plural light emitting portions).

As a means for solving the above-discussed problems, U.S. Pat. No. 6,489,982 (the assignee thereof is the same as this U.S. patent application) discloses technology for effectively reducing the displacement $\delta Y_1$ in the main-scanning direction of the image location of each light beam emitted from each of plural light sources by appropriately setting the focal length of the collimator lens, the distance between the stop and the deflecting facet of the polygon mirror, the focal length of the fθ lens in the main-scanning direction, the spacing between light emitting points of the plural light sources in the main-scanning direction, and so forth.

The construction of the above U.S. Patent is capable of lowering the displacement $\delta Y_1$ in the main-scanning direction of the image location of each light beam emitted from each of the plural light sources to a level that is practically allowable.

On the other hand, laser oscillation is liable to be unstable, in the event that plural light beams incident on the photosensitive drum surface are regularly reflected by the photosensitive drum surface, and are again returned to the light emitting portions such as semiconductor lasers. Further, when the regularly-reflected light returns to the optical system, there is a possibility that the reflected light is again returned to the photosensitive drum surface by reflection at a surface of the optical system, and a problem of ghost accordingly appears.

Therefore, as illustrated in FIG. 27, the construction is designed such that a principal ray of each of plural light beams incident on the photosensitive drum surface can form a predetermined angle α relative to a normal to the photosensitive drum surface in the sub-scanning direction. In such a construction, accordingly, the regularly-reflected light from the photosensitive drum surface returns to neither the semiconductor laser, nor the optical system. FIG. 27 is a cross-sectional view in the sub-scanning direction schematically illustrating a main portion of the above-discussed conventional multi-beam optical scanning apparatus using a plurality of light sources.

In the multi-beam optical scanning apparatus having such a construction, lengths of plural scanning lines formed on the photosensitive drum surface are likely to differ from each other as illustrated in FIG. 28. Hence, a displacement or variation in the main-scanning direction between the image locations of plural image spots occurs on the photosensitive drum surface, especially at its end portions in the main-scanning direction.

The displacement or variation in the main-scanning direction of the image location depends on an average α of angles formed between principal rays of the plural light beams incident on the photosensitive drum surface and the normal to the photosensitive drum surface in the sub-scanning direction, an average β of angles formed between principal rays of the plural light beams incident at any scanning location (any given scanning location) on the photosensitive drum surface and the normal to the photosensitive drum surface in the main-scanning direction, a resolution in the sub-scanning direction (a pitch of the scanning lines), and the number of simultaneously-scanned scanning lines (the number of light emitting portions of the light source unit).

In other words, the displacement or variation in the main-scanning direction of the image location on the scanned surface 97 is a sum of a positional displacement $\delta Y_1$ caused by the arrangement of plural light emitting portions oblique to the main-scanning direction (i.e., along the sub-scanning direction), and a positional displacement $\delta Y_D$ caused by the arrangement in which the angle formed between the principal ray of each of plural light beams incident on the photosensitive drum surface and the normal to the photosensitive drum surface in the sub-scanning direction is set to a predetermined angle α, thereby incurring the problems of a decrease in the printing precision and degradation of the image quality.

Therefore, it can be understood from the above that it is necessary to consider not only the reduction of the positional displacement $\delta Y_1$ in the main-scanning direction of the image location of the light beam from each of plural light sources executed by the method disclosed in the above-identified U.S. patent, but also the positional displacement $\delta Y_D$ caused by the arrangement in which the angle formed between the principal ray of each of plural light beams incident on the photosensitive drum surface and the normal to the photosensitive drum surface in the sub-scanning direction is set to a predetermined angle α.

SUMMARY OF THE INVENTION

It is an object of the present invention to provide a multi-beam optical scanning apparatus which is capable of effectively reduce the displacement or variation of an image location of each light beam emitted from each light emitting portion of a light source unit without any sophisticated adjustment, and which is suitably usable in a high-speed apparatus with a high image quality. Further, it is another object of the present invention to provide an image forming apparatus using the above multi-beam optical scanning apparatus.

According to one aspect of the present invention, there is provided a multi-beam optical scanning apparatus which includes a light source unit having three or more than three (i.e., at least three) light emitting or radiation portions arranged with being spaced from each other in a main-scanning direction, a first optical system for changing conditions of at least three divergent light beams emitted from the light source unit, a stop for restricting widths of the at least three light beams transmitted through the first optical system at least in the main-scanning direction, a deflecting unit for reflecting the at least three light beams transmitted through the stop, a second optical system for forming images of the at least three light beams reflected by the deflecting unit on a surface to be scanned (a scanned surface), and a detecting unit for detecting a writing start position synchronous signal for controlling a timing of a scanning start position on the scanned surface. In the multi-beam optical scanning apparatus, the writing start position synchronous signal detecting unit includes a detecting device or element for detecting the writing start position synchronous signal, and a slit member disposed in an optical path between the writing start position synchronous signal detecting device and the deflecting unit, and the timing of the scanning start position on the scanned surface is controlled by using a light beam reflected by the deflecting unit and transmitted through the slit member. Further, the multi-beam optical scanning apparatus satisfies the following condition given by $$\left|P\sin\alpha\tan\beta + \frac{S_1 L_1}{f_1 f_2}(\delta M_{(\beta)} - \delta M_{(BD)})\right| \leq \frac{25.4}{3N_M}$$

where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $\alpha$ is an average of angles formed between principal rays of the at least three light beams incident on the scanned surface and a normal to the scanned surface in a sub-scanning section, $\beta$ is an average of angles formed between the principal rays of the at least three light beams incident at any scanning location on the scanned surface and the normal to the scanned surface in a main-scanning section, $\delta M_{(\beta)}$ is the main-scanning focus displacement amount at the scanning location of the average $\beta$ (whereat the latter average is $\beta$), $\delta M_{(BD)}$ is the main-scanning focus displacement amount at a scanning location whereat the at least three light beams pass through the slit member, $N_M$ is the number of pixels per inch in the main-scanning direction which is determined from a resolution in the main-scanning direction on the scanned surface, and P is the spacing in the sub-scanning direction between image spots of light beams emitted from light emitting portions at opposite ends in the at least three light emitting portions on the scanned surface.

According to another aspect of the present invention, there is provided a multi-beam optical scanning apparatus which includes a light source unit having three or more than three (i.e., at least three) light emitting or radiation portions disposed with being spaced from each other in a main-scanning direction, a first optical system for changing conditions of at least three divergent light beams emitted from the light source unit, a stop for restricting widths of the at least three light beams transmitted through the first optical system at least in the main-scanning direction, a deflecting unit for reflecting the at least three light beams transmitted through the stop, a second optical system for forming images of the at least three light beams reflected by the deflecting unit on a surface to be scanned (a scanned surface), and a detecting unit for detecting a writing start position synchronous signal for controlling a timing of a scanning start position on the scanned surface. In the multi-beam optical scanning apparatus, the writing start position synchronous signal detecting unit includes a third optical system disposed independently from the second optical system, a detecting device for detecting the writing start position synchronous signal, and a slit member disposed in an optical path between the writing start position synchronous signal detecting device and the third optical system unit, and the timing of the scanning start position on the scanned surface is controlled by using a light beam reflected by the deflecting unit. Further, the multi-beam optical scanning apparatus satisfies the following condition given by $$\left|P\sin\alpha\tan\beta + \frac{S_1 L_1}{f_1 f_2}\delta M_{(\beta)} - \frac{S_1 L_1}{f_1 f_3}\delta M_{(BD)}\right| \leq \frac{25.4}{3N_M}$$

where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $f_3$ is the focal length of the third optical system in the main-scanning direction, $\alpha$ is an average of angles formed between principal rays of the at least three light beams incident on the scanned surface and a normal to the scanned surface in a sub-scanning section, $\beta$ is an average of angles formed between the principal rays of the at least three light beams incident at any scanning location on the scanned surface and the normal to the scanned surface in a main-scanning section, $\delta M_{(\beta)}$ is the main-scanning focus displacement amount at the scanning location of the average $\beta$, $\delta M_{(BD)}$ is the main scanning focus displacement amount in the main-scanning direction at a scanning location whereat the at least three light beams pass through the slit member, $N_M$ is the number of pixels per inch in the main-scanning direction which is determined from a resolution in the main-scanning direction on the scanned surface, and P is the spacing in the sub-scanning direction between image spots of light beams emitted from light emitting portions at opposite ends in the at least three light emitting portions on the scanned surface.

Further, the writing start position synchronous signal detecting unit can be adapted to control the timing of the scanning start position on the scanned surface by using all of the at least three light beams reflected by the deflecting unit.

Further, the slit member can be adapted to be movable in a direction in which the at least three light beams incident on the slit member travel.

Furthermore, the slit member can be adapted to be rotatable in a section approximately perpendicular to the direction in which the at least three light beams incident on the slit member travel.

Moreover, a light beam reflected by the deflecting unit and incident on the writing start position synchronous signal detecting device can be adapted to pass through the second optical system.

According to still another aspect of the present invention, there is provided an image forming apparatus which includes the above-described multi-beam optical scanning apparatus, a photosensitive member disposed on the scanned surface, a developing device for developing as a toner image an electrostatic latent image formed on the photosensitive member by the light beams scanned by the above-described multi-beam optical scanning apparatus, a transferring device for transferring the developed toner image onto a transferring material, and a fixing device for fixing the transferred toner image to the transferring material.

According to still another aspect of the present invention, there is provided an image forming apparatus which includes the above-described multi-beam optical scanning apparatus, and a printer controller for converting code data input from an external equipment or apparatus into an image signal, and inputting the image signal into the above-described multi-beam optical scanning apparatus.

According to still another aspect of the present invention, there is provided a color image forming apparatus which includes the above-described multi-beam optical scanning apparatuses, and a plurality of image bearing members each of which is disposed on the scanned surface of each of the multi-beam optical scanning apparatuses, and on which different color images are formed, respectively.

Further, the above-described color image forming apparatus includes a printer controller for converting color signals input from an external equipment or apparatus into image data of different colors, and inputting the image data into the above-described multi-beam optical scanning apparatuses, respectively.

According to still another aspect of the present invention, there is provided a multi-beam optical scanning apparatus which includes a light source unit having three or more than three (i.e., at least three) light emitting or radiation portions disposed with being spaced from each other in a main-scanning direction, a first optical system for changing conditions of at least three divergent light beams emitted from the light source unit, a stop for restricting widths of the at least three light beams transmitted through the first optical system at least in the main-scanning direction, a deflecting unit for reflecting the at least three light beams transmitted through the stop, a second optical system for forming images of the at least three light beams reflected by the deflecting unit on a surface to be scanned (a scanned surface), and a detecting unit for detecting a writing start position synchronous signal for controlling a timing of a scanning start position on the scanned surface. In the multi-beam optical scanning apparatus, the writing start position synchronous signal detecting unit includes a detecting device for detecting the writing start position synchronous signal. Further, the multi-beam optical scanning apparatus satisfies the following condition given by $$\left|P\sin\alpha\tan\beta + \frac{S_1L_1}{f_1f_2}(\delta M_{(\beta)} - \delta M_{(BD)})\right| \leq \frac{25.4}{3N_M}$$

where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $\alpha$ is an average of angles formed between principal rays of the at least three light beams incident on the scanned surface and a normal to the scanned surface in a sub-scanning section, $\beta$ is an average of angles formed between the principal rays of the at least three light beams incident at any scanning location on the scanned surface and the normal to the scanned surface in a main-scanning section, $\beta M_{(\beta)}$ is the main-scanning focus displacement amount at the scanning location of the average $\beta$, $\delta M_{(BD)}$ is the main-scanning focus displacement amount at a light receiving surface whereat the writing start position synchronous signal detecting device receives the at least three light beams, $N_M$ is the number of pixels per inch in the main-scanning direction which is determined from a resolution in the main-scanning direction on the scanned surface, and P is the spacing in the sub-scanning direction between image spots of light beams emitted from light emitting portions at opposite ends in the at least three light emitting portions on the scanned surface.

According to still another aspect of the present invention, there is provided a multi-beam optical scanning apparatus which includes a light source unit having three or more than three (i.e., at least three) light emitting or radiation portions disposed with being spaced from each other in a main-scanning direction, a first optical system for changing conditions of at least three divergent light beams emitted from the light source unit, a stop for restricting widths of the at least three light beams transmitted through the first optical system at least in the main-scanning direction, a deflecting unit for reflecting the at least three light beams transmitted through the stop, a second optical system for forming images of the at least three light beams reflected by the deflecting unit on a surface to be scanned (a scanned surface), and a detecting unit for detecting a writing start position synchronous signal for controlling a timing of a scanning start position on the scanned surface. In the multi-beam optical scanning apparatus, the writing start position synchronous signal detecting unit includes a third optical system disposed independently from the second optical system, and a detecting device for detecting the writing start position synchronous signal. Further, the multi-beam optical scanning apparatus satisfies the following condition given by $$\left|P\sin\alpha\tan\beta + \frac{S_1L_1}{f_1f_2}\delta M_{(\beta)} - \frac{S_1L_1}{f_1f_3}\delta M_{(BD)}\right| \leq \frac{25.4}{3N_M}$$

where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $f_3$ is the focal length of the third optical system in the main-scanning direction, $\alpha$ is an average of angles formed between principal rays of the at least three light beams incident on the scanned surface and a normal to the scanned surface in a sub-scanning section, $\beta$ is an average of angles formed between the principal rays of the at least three light beams incident at any scanning location on the scanned surface and the normal to the scanned surface in a main-scanning section, $\delta M_{(\beta)}$ is the main-scanning focus displacement amount at the scanning location of the average $\beta$, $\delta M_{(BD)}$ is the main-scanning focus displacement amount on a light receiving surface whereat the writing start position synchronous signal detecting device receives the at least three light beams, $N_M$ is the number of pixels per inch in the main-scanning direction which is determined from a resolution in the main-scanning direction on the scanned surface, and P is the spacing in the sub-scanning direction between image spots of light beams emitted from light emitting portions at opposite ends in the at least three light emitting portions on the scanned surface.

Further, the writing start position synchronous signal detecting unit can be adapted to control the timing of the scanning start position on the scanned surface by using all of the at least three light beams reflected by the deflecting unit.

Moreover, a light beam reflected by the deflecting unit and incident on the writing start position synchronous signal detecting device can be adapted to pass through the second optical system.

According to still another aspect of the present invention, there is provided an image forming apparatus which includes the above-described multi-beam optical scanning apparatus, a photosensitive member disposed on the scanned surface, a developing device for developing as a toner image an electrostatic latent image formed on the photosensitive member by the light beams scanned by the above-described multi-beam optical scanning apparatus, a transferring device for transferring the developed toner image onto a transferring material, and a fixing device for fixing the transferred toner image to the transferring material.

According to still another aspect of the present invention, there is provided an image forming apparatus which includes the above-described multi-beam optical scanning apparatus, and a printer controller for converting code data input from an external equipment or apparatus into an image signal, and inputting the image signal into the above-described multi-beam optical scanning apparatus.

According to yet still another aspect of the present invention, there is provided a color image forming apparatus which includes the above-described multi-beam optical scanning apparatuses, and a plurality of image bearing members each of which is disposed on the scanned surface of each of the multi-beam optical scanning apparatuses, and on which different color images are formed, respectively.

Further, the above-described color image forming apparatus can include a printer controller for converting color signals input from an external equipment or apparatus into image data of different colors, and inputting the image data into the above-described multi-beam optical scanning apparatuses, respectively.

These and further aspects and features of the invention will become apparent from the following detailed description of preferred embodiments thereof in conjunction with the accompanying drawings.

BRIEF DESCRIPTION OF THE DRAWINGS

FIG. 8 is a table showing numerical data of the first embodiment according to the present invention;

FIG. 15 is a table showing numerical data of the second embodiment according to the present invention;

DETAILED DESCRIPTION OF THE PREFERRED EMBODIMENTS (First Embodiment)

Figure 1:
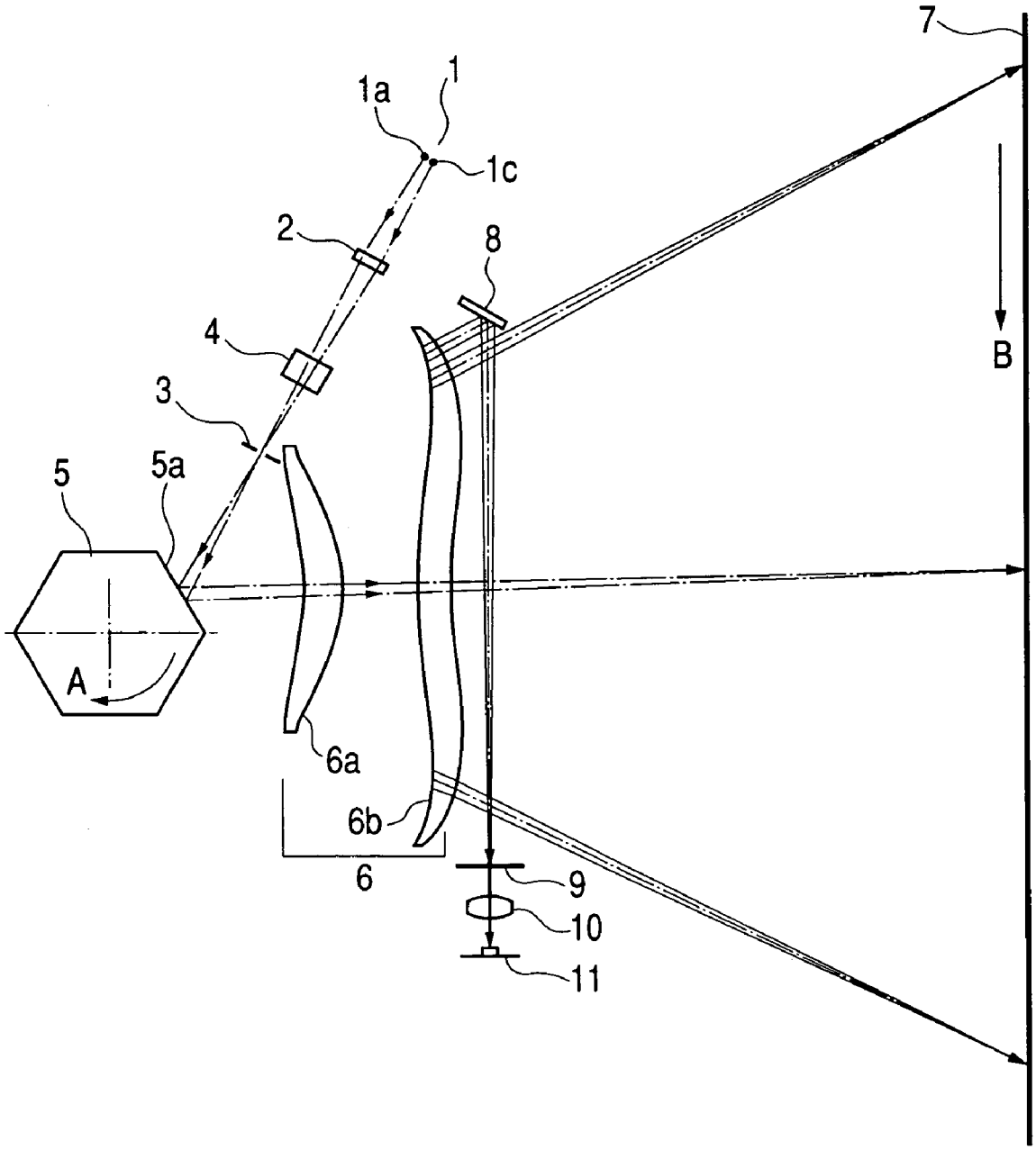
FIG. 1 is a cross-sectional view in a main-scanning section illustrating a first embodiment according to the present invention.

FIG. 1 is a cross-sectional view in a main-scanning direction illustrating a main portion of a multi-beam optical scanning apparatus of a first embodiment according to the present invention.

Here, the main-scanning direction means a direction perpendicular to a rotational axis of a deflecting unit and an optical axis of a scanning optical system (i.e., a direction along which a light beam is reflected (deflection-scanned) by the deflecting unit), and the sub-scanning direction means a direction parallel to the rotational axis of the deflecting unit. Further, the main-scanning section means a plane parallel to the main-scanning direction and including the optical axis of the scanning optical system. The sub-scanning section means a plane perpendicular to the main-scanning section.

In FIG. 1, reference numeral 1 represents a light source unit comprised of a plurality of light emitting or radiation portions spaced from each other in both the main-scanning direction and the sub-scanning direction. More specifically, the light source unit 1 is comprised of, for example, a monolithic multi-beam semiconductor laser having three light emitting portions (light emitting points) 1*a*, 1*b* and 1*c*. In FIG. 1, however, the light emitting portion 1*b* is omitted for the convenience of simplicity. The light emitting portion 1*b* is present at any desired location between the light emitting portions 1*a* and 1*c*. The above light source unit can be replaced by a light source unit including four or more than four light emitting portions.

Reference numeral 2 represents a converting optical element (a collimator lens) serving as a first optical system. The converting optical element 2 changes condensing conditions of three divergent light beams emitted from the multi-beam semiconductor laser 1. In other words, the converting optical element 2 changes the diverging degree of the light beam, changes the divergent light beam into a parallel light beam, or changes the divergent light beam into a convergent light beam.

Reference numeral 4 represents a cylindrical lens having a predetermined refractive power only in the sub-scanning section. Reference numeral 3 represents an aperture stop (a stop) for restricting the width of an incident light beam. The aperture stop 3 is interposed between the collimator lens 2 and an optical deflector 5.

Reference numeral 5 represents the optical deflector (serving as a deflecting unit) comprised of a polygon mirror (a rotary multi-facet mirror), for example, which is adapted to be rotated at a uniform speed in a direction of an arrow A by a driving unit (not shown), such as a polygon motor, such that an incident light beam can be reflected in the main-scanning direction.

Reference numeral 6 represents an fθ lens system (an imaging optical system) serving as a second optical system, which has fθ characteristic, and consists of two lenses of first and second fθ lenses 6*a* and 6*b*. The scanning optical system 6 not only establishes an approximate conjugate relationship between a deflecting facet 5*a* of the optical deflector 5 and a surface 7 to be scanned (a scanned surface) in the sub-scanning section, but also forms an image of the light beam based on image data and reflected by the optical deflector 5 on a photosensitive drum surface 7 serving as the scanned surface. The fθ lens system can be comprised of a single lens, or three or more than three lenses. Further, the fθ lens system can include a diffractive optical element, or can be a reflective optical system in place of the lens system.

Reference numeral 7 represents the surface of the photosensitive drum serving as the scanned surface.

Reference numeral 8 represents a folding mirror (a BD mirror) for synchronous detection, which reflects toward a side of a BD sensor 11 (described later) a light beam (a BD light beam) for detection of a writing start position synchronous signal for detecting a timing of a scanning start position on the photosensitive drum surface 7.

Reference numeral 9 represents a slit member (a BD slit) which is disposed at a location optically equivalent to a location of the photosensitive drum surface 7, or at a location in its vicinity.

Reference numeral 10 represents an imaging lens (a BD lens) for synchronous detection, which establishes a conjugate relationship between the BD mirror 8 and a BD sensor 11 such that the light beam can be always incident on the BD sensor even if a reflective surface of the BD mirror 8 falls.

Reference numeral 11 represents a synchronous detecting device (the BD sensor). In this embodiment, the synchronous detecting device 11 is adapted to control the timing of a scanning start position of image recording on the photosensitive drum surface 7 by using a synchronous signal (a BD signal) obtained by detection of an output signal from the BD sensor 11.

Elements of the BD mirror 8, the BD slit 9, the BD lens 10, the BD sensor 11 and the like constitute a portion of a writing start position synchronous signal detecting unit (a BD optical system). The writing start position synchronous signal detecting unit controls the timing of the scanning start position on the scanned surface by using the light beam reflected by the optical deflector 5 and transmitted through the fθ lens system 6.

In the first embodiment, condensing conditions of three divergent light beams emitted from the multi-beam semiconductor laser 1 and optically modulated according to image information are changed by the collimator lens 2, and these light beams are incident on the cylindrical lens 4. Each light beam incident on the cylindrical lens 4 emerges therefrom without any change in the main-scanning section. With respect to the sub-scanning section, each light beam is converged, is passed through the aperture stop 3 with its cross-sectional shape being restricted, and is imaged on a place close to the deflecting facet 5*a* of the optical deflector 5 as a linear image extending in the main-scanning direction.

Since the three light emitting portions are arranged on the multi-beam semiconductor laser 1 with being spaced from each other at least in the main-scanning direction, three light beams therefrom enter the deflecting facet 5*a* at different angles in the main-scanning section, respectively.

Each of the three light beams reflected by the deflecting facet 5*a* of the optical deflector 5 is imaged on the photosensitive drum surface 7 in the form of a spot by the fθ lens system 6. The photosensitive drum surface 7 is scanned with the thus-imaged spot moving at a uniform speed in the direction of the arrow B (the main-scanning direction) when the optical deflector 5 is rotated in the direction of the arrow A. Accordingly, image recording can be executed on the photosensitive drum surface 7 serving as the recording material.

In the first embodiment, the writing start point of each light beam on the photosensitive drum surface 7 is determined in the following manner.

The BD detection is performed by detecting the timings at which plural light beams (the BD light beams) reach the BD sensor 11 disposed upstream the photosensitive drum surface 7 in the main-scanning direction, and such BD detection is independently executed for each light beam. The writing by each light beam is started after a predetermined delay time from the BD detection of each light beam.

The BD slit 9 is disposed at the image position of each light beam (a position equivalent to the photosensitive drum surface 7) in front of the BD sensor 11 to more accurately detect the arrival timing of each light beam at the BD sensor 11. The BD signal is output when an output from the BD sensor 11 at the time of passage of each light beam through the BD slit 9 exceeds a predetermined value, and the image signal is supplied after a predetermined delay time T1 from this output time point.

The writing start positions for respective light beams (scanned light beams) are caused to coincide with each other when the above operation is conducted for each light beam.

In FIG. 1, depiction is made in such a manner that the light beam emitted from the light emitting portion 1*a* and reflected rightward by the deflecting reflective facet 5*a* is reflected approximately parallel to and in the same direction as the light beam emitted from the light emitting portion 1*c* and reflected rightward by the deflecting reflective facet 5*a*, but as described in the related background art, the timing of the light beam emitted from the light emitting portion 1*c* and reflected rightward by deflecting reflective facet 5*a* is actually delayed by a predetermined time δT from the timing of the light beam emitted from the light emitting portion 1*a* and reflected rightward by deflecting reflective facet 5*a*. It should be noted that FIG. 1 illustrates the light beams whose timings are shifted from each other by δT.

Figure 2:
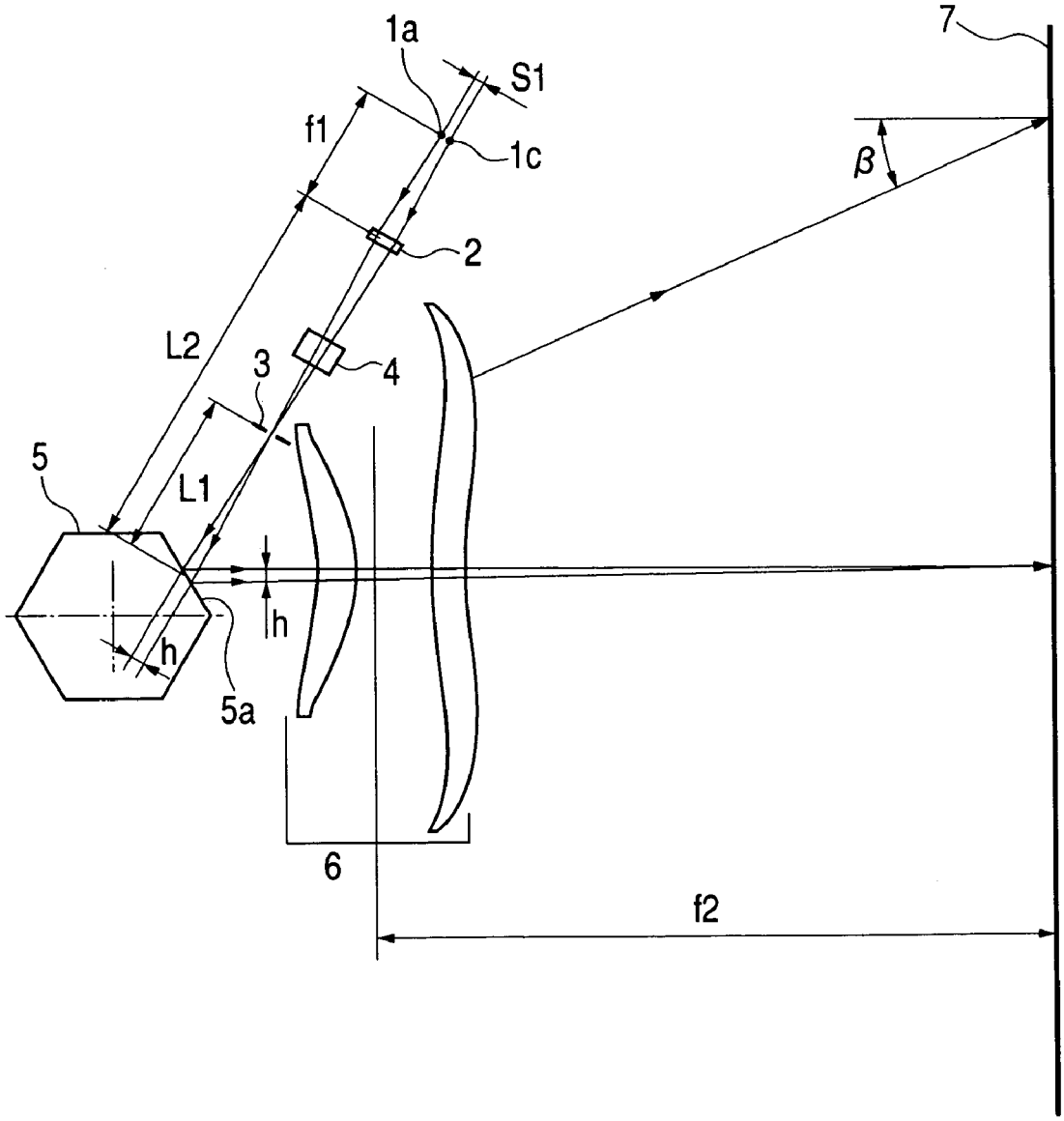
FIG. 2 is a cross-sectional view in the main-scanning section illustrating a scanning manner of a plurality of light beams in the first embodiment according to the present invention.

FIG. 2 is a cross-sectional view of the first embodiment in the main-scanning section illustrating a condition under which three light beams scan an approximately central portion of the photosensitive drum surface 7 in the main-scanning direction. In FIG. 2, the light emitting portion 1*b* is omitted for the convenience of simplicity, similarly to FIG. 1. It is assumed that the light emitting portion 1*b* is interposed between the light emitting portion 1*a* and the light emitting portion 1*c*.

In FIG. 2, an interval amount h on the deflecting facet 5*a* between principal rays of the light beams emitted from the light emitting portions 1*a* and 1*c* is given by $$h = S_1 \times \frac{L_1}{f_1}$$

where $S_1$ is the spacing in the main-scanning direction between the light emitting portions 1*a* and 1*c* at opposite ends, $f_1$ is the focal length of the collimator lens 2, $L_1$ is the distance between the stop 3 and the deflecting facet 5*a* of the optical deflector 5, $L_2$ is the distance between the collimator lens 2 and the deflecting facet 5*a* of the optical deflector 5, and $f_2$ is the focal length of the fθ lens system 6 in the main-scanning direction.

The light beams reflected by the deflecting facet 5*a* are incident on the fθ lens system 6 at the same angle as discussed above, respectively. Accordingly, the tangent of the angle between principal rays of the respective light beams emerging from the fθ lens system 6 can be approximated by $$\frac{h}{f_2} = \frac{S_1}{f_2} \times \frac{L_1}{f_1}$$

It can be readily understood that a value on the right-hand side of the above formula represents the displacement or variation amount of the image location in the main-scanning direction on the photosensitive drum surface 7 for each light beam emitted from each of the light emitting portions 1*a* and 1*c* appearing in the event that main-scanning focusing (focusing of the fθ lens system 6 in its optical axial direction) is displaced or varied by 1 mm.

Accordingly, where δM is the actual main-scanning focus displacement amount at the scanning location of FIG. 2, the displacement or variation amount $\delta Y_1$ of the image location in the main-scanning direction on the photosensitive drum surface 7 for each light beam emitted from each of the light emitting portions 1*a* and 1*c* in this instance is given by $$\delta Y_1 = \frac{S_1 L_1}{f_1 f_2} \delta M \tag{1}$$

Therefore, when the main-scanning focus displacement amount δM (the focus displacement amount here is defined by a focus displacement amount of a light beam emitted from a light emitting portion disposed closest to the optical axis of the collimator lens 2 out of the plural light emitting portions, and in the first embodiment this is the focus displacement amount of the light beam emitted from the light emitting portion 1*b*) is present, a displacement $\delta Y_1$ is likely to occur in the image location in the main-scanning direction on the photosensitive drum surface 7 for each of the light beams emitted from the light emitting portions 1*a* and 1*c* even if the BD detection is independently performed for each light beam by the BD sensor 11 disposed upstream the photosensitive drum surface 7 in the main-scanning direction as discussed above.

Such a phenomenon occurs even when each light beam is passed through the BD slit 9. Where $\delta M_{(BD)}$ is the main-scanning focus displacement amount at a scanning location whereat each light beam passes through the BD slit 9 (the focus displacement amount here is defined by a focus displacement amount of the light beam emitted from the light emitting portion disposed closest to the optical axis of the collimator lens 2 in the plural light emitting portions, and in the first embodiment this is the focus displacement amount of the light beam emitted from the light emitting portion 1*b*), a displacement amount $\delta Y_{BD}$ of the image location in the main-scanning direction on the BD slit 9 for each of the light beams emitted from the light emitting portions 1*a* and 1*c* is given by $$\delta Y_{BD} = \frac{S_1 L_1}{f_1 f_2} \delta M_{(BD)} \tag{2}$$

Accordingly, when the main-scanning focus displacement amount $\delta M_{(BD)}$ at the scanning location whereat each light beam passes through the BD slit 9 exists, a relative displacement corresponding to the above displacement amount $\delta Y_{BD}$ occurs in the BD detection of each light beam emitted from each of the light emitting portions 1*a* and 1*c*.

Therefore, even if no main-scanning focus displacement is present in an effective scanning region on the photosensitive drum surface 7 for image recording, a shift of the above amount $\delta Y_{BD}$ between BD detection timings of the light beams emitted from the light emitting portions 1*a* and 1*c* appears when the main-scanning focus displacement $\delta M_{(BD)}$ exists at the scanning position of passage through the BD slit 9, i.e., at the location of the BD detection. It can be easily understood from the above that the displacement $\delta Y_{BD}$ given by the formula (2) consequently occurs with respect to the image location in the main-scanning direction in the effective scanning region on the photosensitive drum surface 7 for each of the light beams emitted from the light emitting portions 1*a* and 1*c*.

Further, in the event that the main-scanning focus displacement δM is present in the effective scanning region on the photosensitive drum surface 7 for image recording, and at the same time the main-scanning focus displacement $\delta M_{(BD)}$ exists at the location of the BD detection, not only the displacement $\delta Y_1$ given by the formula (1) occurs in the image location in the main-scanning direction in the effective scanning region on the photosensitive drum surface 7 for each of the light beams emitted from the light emitting portions 1*a* and 1*c*, but also the shift of the amount $\delta Y_{BD}$ given by the formula (2) appears between the BD detection timings of the light beams emitted from the light emitting portions 1*a* and 1*c*. Therefore, it can also be easily understood that the shift between the BD detection timings is cancelled, and consequently the displacement of the amount $\delta Y_1 - \delta Y_{BD}$ of the image location finally remains.

To paraphrase the above discussion, the displacement amount $\delta Y_{focus}$ of the image location in the main-scanning direction in the effective scanning region on the photosensitive drum surface 7 for image recording is written as $$\delta Y_{focus} = \delta Y_1 - \delta Y_{BD} = \frac{S_1 L_1}{f_1 f_2} \delta M_{(\beta)} - \frac{S_1 L_1}{f_1 f_2} \delta M_{(BD)} = \frac{S_1 L_1}{f_1 f_2} (\delta M_{(\beta)} - \delta M_{(BD)}) \tag{3}$$

where $S_1$ is the spacing in the main-scanning direction between the light emitting portions 1*a* and 1*c* at opposite ends in the three light emitting portions 1*a*, 1*b* and 1*c*, $f_1$ is the focal length of the collimator lens 2, $L_1$ is the distance between the stop 3 and the deflecting facet 5*a* of the optical deflector 5, $f_2$ is the focal length of the fθ lens system 6 in the main-scanning direction, $\delta M_{(\beta)}$ is the main-scanning focus displacement amount at any scanning location whereat the average of angles formed between principal rays of the three light beams incident on the photosensitive drum surface 7 and the normal to the photosensitive drum surface 7 is β, and $\delta M_{(BD)}$ is the main-scanning focus displacement amount at the scanning location whereat the three light beams pass through the slit 9.

It can be understood from the formula (3) that when the main-scanning focus displacement amount $\delta M_{(\beta)}$ in the effective scanning region on the photosensitive drum surface 7 for image recording is equal to the main-scanning focus displacement amount $\delta M_{(BD)}$ at the location of the BD detection, the displacement amount $\delta Y_{focus}$ of the image location in the main-scanning direction becomes null.

Figure 3:
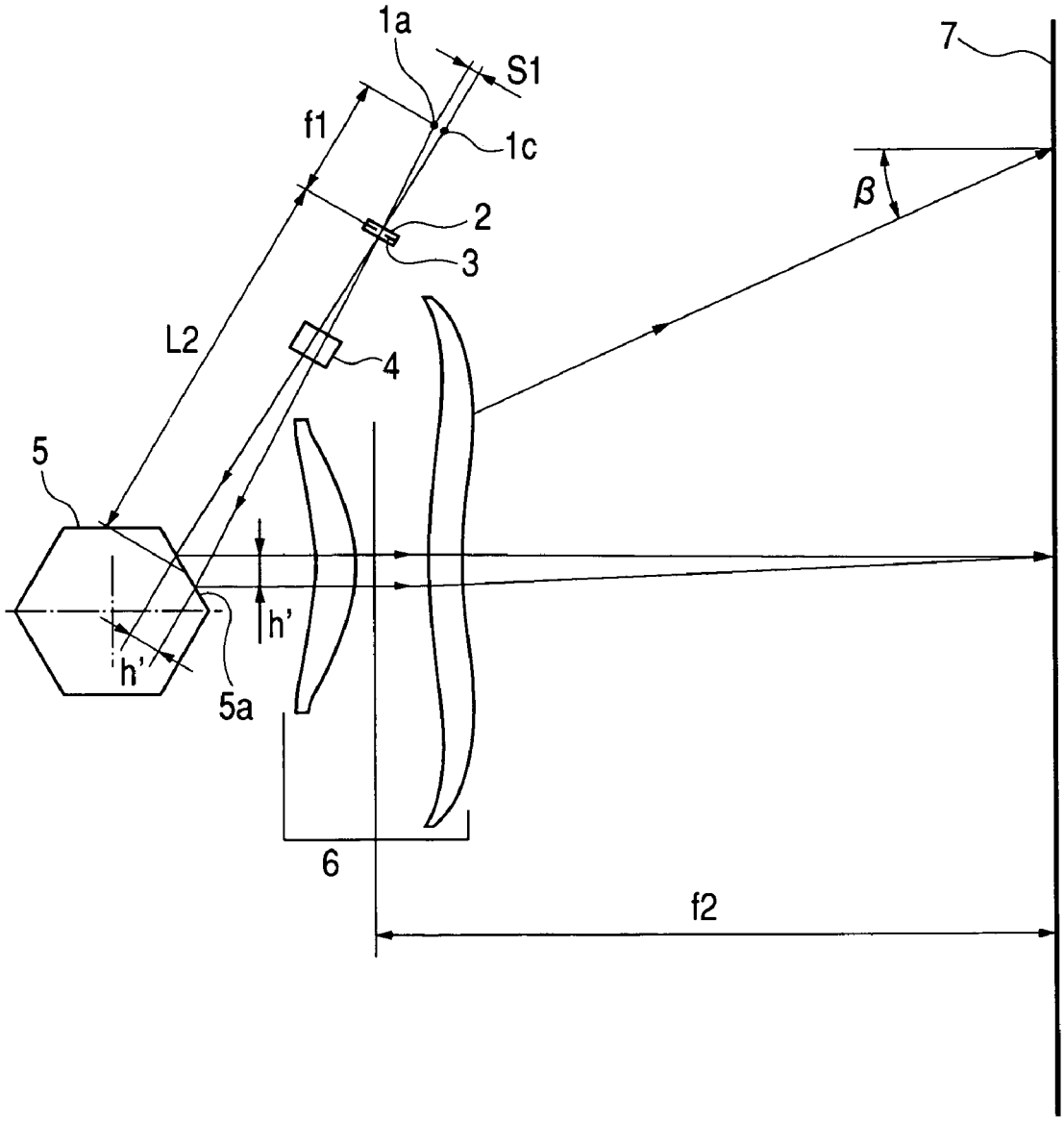
FIG. 3 is a cross-sectional view in the main-scanning section illustrating a comparative example of the first embodiment according to the present invention.

A comparative example will be described with reference to FIG. 3 which is similar to FIG. 2. FIG. 3 is a cross-sectional view in the main-scanning section illustrating a case where the aperture stop 3 is disposed at a location of the collimator lens 2. In FIG. 3, the light emitting portion 1*b* is omitted for the convenience of simplicity, similarly to FIG. 2. It is assumed that the light emitting portion 1*b* is interposed between the light emitting portion 1*a* and the light emitting portion 1*c*.

In this case, an interval amount h' on the deflecting facet 5*a* between principal light rays of the light beams emitted from the light emitting portions 1*a* and 1*c* is given by $$h' = S_1 \times \frac{L_2}{f_1}$$

Accordingly, where δM is the actual main-scanning focus displacement amount at the scanning location of FIG. 3, a displacement or variation amount $\delta Y_1'$ of the image location in the main-scanning direction on the photosensitive drum surface 7 for each light beam emitted from each of the light emitting portions 1*a* and 1*c* in this instance is given by $$\delta Y_1' = \frac{S_1 L_2}{f_1 f_2} \delta M$$

Similarly, where $\delta M_{(BD)}$ is the main-scanning focus displacement amount at the scanning location whereat each light beam passes through the BD slit 9, a displacement amount $\delta Y_{BD}'$ of the image location in the main-scanning direction on the BD slit 9 for each of the light beams emitted from the light emitting portions 1*a* and 1*c* in this instance is given by $$\delta Y_{BD}' = \frac{S_1 L_{21}}{f_1 f_2} \delta M_{(BD)}$$

Therefore, in the event that the aperture stop 3 is disposed at the location of the collimator lens 2 as illustrated in FIG. 3, a displacement amount $\delta Y_{focus}'$ of the image location in the main-scanning direction in the effective scanning region on the photosensitive drum surface 7 for image recording is written as $$\delta Y_{focus}' = \delta Y_1' - \delta Y_{BD}' = \frac{S_1 L_2}{f_1 f_2} (\delta M_{(\beta)} - \delta M_{(BD)}) \tag{4}$$

Here, when the formula (3) is compared with the formula (4), it can be understood that the following relation holds $$\delta Y_{focus} = \frac{L_1}{L_2} \delta Y_{focus}'$$

This relation means the fact that the displacement amount of the image location in the main-scanning direction in the effective scanning region on the photosensitive drum surface 7 for image recording can be oppressed more in a case where the aperture stop 3 is disposed at a place near the deflecting facet 5*a* as illustrated in FIG. 2 than in a case where the aperture stop 3 is disposed at the location of the collimator lens 2 as illustrated in FIG. 3.

In the first embodiment, even if there exist the main-scanning focus displacement in the effective scanning region, the main-scanning focus displacement at the scanning location for the BD detection, and the like, the displacement amount of the image location in the main-scanning direction in the effective scanning region on the photosensitive drum surface 7 for image recording is effectively oppressed by arranging the aperture stop 3 at the place close to the deflecting facet 5*a*. A multi-beam optical scanning apparatus suitable for a high-speed and high-image-quality application can be thus achieved.

Figure 4:
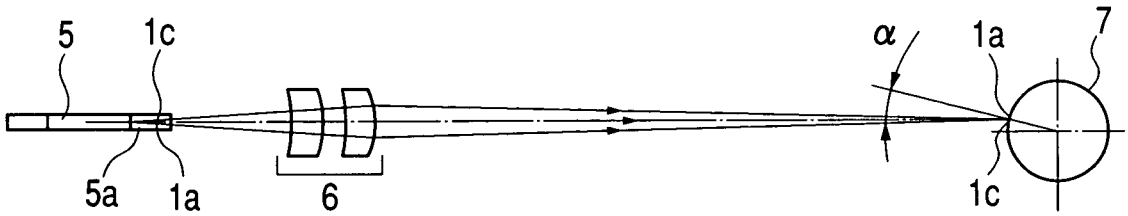
FIG. 4 is a cross-sectional view in a sub-scanning section illustrating the first embodiment according to the present invention.

FIG. 4 is a cross-sectional view in the sub-scanning section illustrating the multi-beam optical scanning apparatus of the first embodiment. In FIG. 4, like reference characters designate the same elements as those illustrated in FIG. 1.

In the first embodiment, in order that regularly-reflected light from the photosensitive drum surface 7 does not return to the optical system again, the average of the angles between principal rays of plural (three in this embodiment) light beams incident on the photosensitive drum surface 7 and the normal to the photosensitive drum surface 7 in the sub-scanning section are set to a predetermined non-zero angle.

Figure 28:
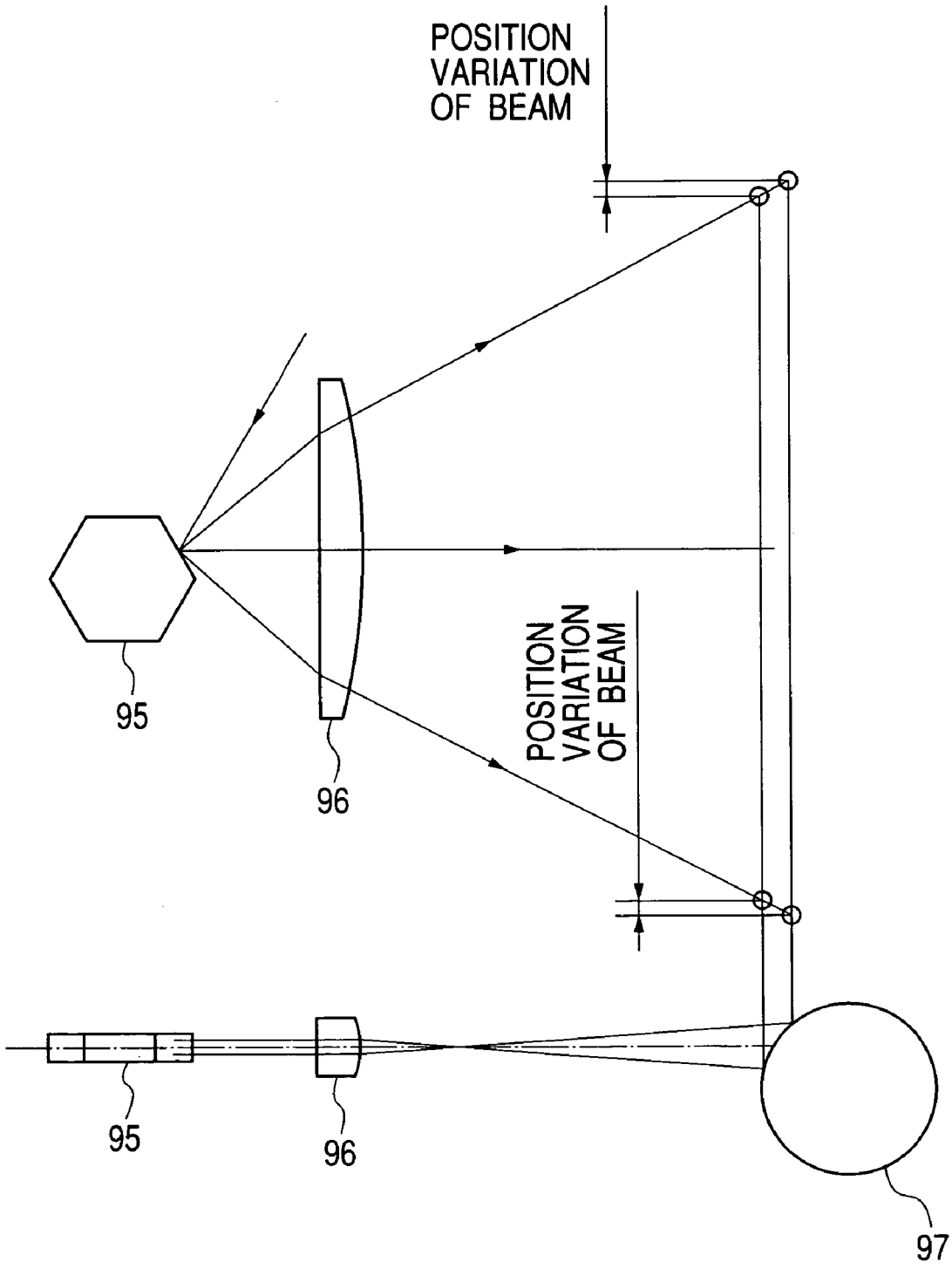
FIG. 28 is a view illustrating a phenomenon that a scanning magnification varies in the event that the relationship in the sub-scanning section between the light beam incident on the photosensitive drum and the normal to the drum is set to a predetermined angle.

In such a construction, lengths of three scanning lines on the photosensitive drum surface are likely to differ as illustrated in FIG. 28, as discussed above. Accordingly, shifts in image locations of three image spots in the main-scanning direction occur on the photosensitive drum surface, especially at its end portions in the main-scanning direction.

The shift of the image location in the main-scanning direction depends on the average α of angles formed between principal rays of the three light beams incident on the photosensitive drum surface 7 and the normal to the photosensitive drum surface 7 in the sub-scanning section, the average β of angles formed between the principal rays of the three light beams incident at any scanning location on the photosensitive drum surface 7 and the normal to the photosensitive drum surface 7 in the main-scanning section, the spacing P in the sub-scanning direction between image spots of the light beams emitted from the light emitting portions 1*a* and 1*c* at opposite ends in the three light emitting portions 1*a*, 1*b* and 1*c* on the photosensitive drum surface 7, and the resolution in the sub-scanning direction.

Figure 5:
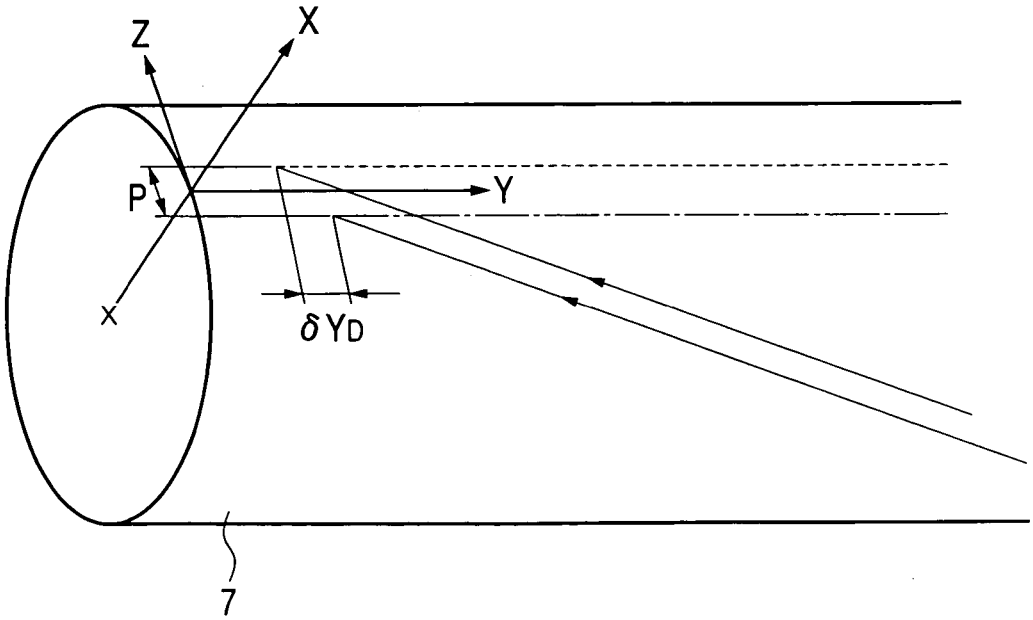
FIG. 5 is a view illustrating a parallel scanning manner of two scanning lines on a photosensitive drum surface.

FIG. 5 is a perspective view illustrating a main portion on the photosensitive drum surface 7 on which two scanning lines are formed in a parallel manner. In FIG. 5, the light beam from the light emitting portion 1*b* is omitted for the convenience of simplicity.

In FIG. 5 illustrating orthogonal coordinates, the Y-axis designates the main-scanning direction, the Z-axis designates the sub-scanning direction (i.e., a direction in which the photosensitive drum moves), and the X-axis designates a direction of the normal to the photosensitive drum surface 7.

In FIG. 5, an angle formed between the XY plane and the main-scanning section (the angle formed between the principal ray of the light beam incident on the photosensitive drum surface 7 and the normal to the photosensitive drum surface in the sub-scanning section) defines α. Here, between two scanning lines formed on the scanned surface by scanning of image spots of two light beams emitted from two light emitting portions 1*a* and 1*c* at opposite ends, a difference δL in the optical path length occurs in a direction in which the light beam travels. The difference δL in the optical path length is given by $$\delta L = P \sin \alpha$$

where P is the spacing in the sub-scanning direction between the scanning lines which are simultaneously formed on the photosensitive drum surface 7.

The displacement amount $\delta Y_D$ of the image location in the main-scanning direction on the photosensitive drum surface 7 in FIG. 5 is given by $$\delta Y_D = P \sin \alpha \tan \beta \quad (5)$$

where β is an angle formed between the principal ray of the light beam incident at any scanning location on the photosensitive drum surface 7 and the optical axis of the fθ lens system (the angle formed between the principal ray of the light beam incident at any scanning location on the photosensitive drum surface 7 and the normal to the photosensitive drum surface 7 in the main-scanning section).

Accordingly, the absolute value of the total displacement amount δY of the image location in the main-scanning direction on the photosensitive drum surface 7 in the first embodiment is the amount of a sum of $\delta Y_{focus}$ represented by the formula (3) and $\delta Y_D$ represented by the formula (5), and can be written as $$|\delta Y| = \left| \frac{S_1 L_1}{f_1 f_2} (\delta M_{(\beta)} - \delta M_{(BD)}) + P \sin\alpha \tan\beta \right|$$

In general, the positional displacement or variation of the image point in the main-scanning direction begins to be readily discernible when it exceeds ⅓ of the pixel pitch per one inch (25.4 mm) in the main-scanning direction which is determined from the resolution in the main-scanning direction on the photosensitive drum surface 7, and influence of the positional displacement on the image becomes unable to neglect.

Therefore, the above total displacement amount δY needs to satisfy the following condition (6)

$$|\delta Y| = \left| P \sin\alpha \tan\beta + \frac{S_1 L_1}{f_1 f_2} (\delta M_{(\beta)} - \delta M_{(BD)}) \right| \leq \frac{25.4}{3 N_M} \quad (6)$$

where $N_M$ is the number of pixels per inch in the main-scanning direction which is determined from resolution in the main-scanning direction on the photosensitive drum surface 7.

In the first embodiment, values of $S_1$, $f_1$, $L_1$, $f_2$, α, β, $\delta M_{(\beta)}$ and $\delta M_{(BD)}$ are appropriately designed so as to satisfy the formula (6), depending on $N_M$ and P where $S_1$ is the spacing in the main-scanning direction between the light emitting portions 1*a* and 1*c* at opposite ends in the three light emitting portions 1*a*, 1*b* and 1*c*, $f_1$ is the focal length of the collimator lens 2, $L_1$ is the distance between the stop 3 and the deflecting facet 5*a* of the optical deflector 5, $f_2$ is the focal length of the fθ lens 6 in the main-scanning direction, α is the average of angles formed between the principal rays of the three light beams incident on the photosensitive drum surface 7 and the normal to the photosensitive drum surface 7 in the sub-scanning section, β is the average of angles formed between the principal rays of the three light beams incident at any scanning location on the photosensitive drum surface 7 and the normal to the photosensitive drum surface 7 in the main-scanning section, $\delta M_{(\beta)}$ is the main-scanning focus displacement amount at the scanning location of the average β, $\delta M_{(BD)}$ is the main-scanning focus displacement amount at the scanning location whereat the three light beams pass through the slit 9, $N_M$ is the number of pixels per inch in the main-scanning direction which is determined from the resolution in the main-scanning direction on the photosensitive drum surface 7, and P is the spacing in the sub-scanning direction between image spots of the light beams emitted from the light emitting portions 1*a* and 1*c* at opposite ends in the three light emitting portions 1*a*, 1*b* and 1*c* on the photosensitive drum surface 7.

Consequently, the displacement amount of the image location in the main-scanning direction in the effective scanning region on the photosensitive drum surface 7 for image recording can be effectively oppressed, thereby accomplishing a multi-beam optical scanning apparatus suitable for a high-speed and high-image-quality application.

Tables 1 and 2 show characteristics of the multi-beam optical scanning apparatus of the first embodiment.

TABLE 1

| | | | |
|---|---|---|---|
| Reference wavelength used | λ | nm | 780 |
| Number of light emitting points | n | | 3 |
| Spacing between light emitting points | 1 | mm | 0.10000 |
| Spacing between light emitting points at opposite ends | S1 | mm | 0.20000 |
| Thickness of cover glass for semiconductor laser | dcg | mm | 0.25000 |
| Refractive index of cover glass for semiconductor laser | n0 | | 1.51072 |
| Distance between light emitting point and first surface of | d1 | mm | 23.67000 |

TABLE 1-continued

| | | | |
|---|---|---|---|
| collimator lens | | | |
| Radius of curvature of first surface of collimator lens | R1 | mm | 182.21200 |
| Thickness of collimator lens | d0 | mm | 2.00000 |
| Refractive index of collimator lens | n1 | | 1.76203 |
| Radius of curvature of second surface of collimator lens | R2 | mm | −20.83080 |
| Distance between first surface of collimator lens and first surface of cylindrical lens | d2 | mm | 22.26000 |
| Radius of curvature in sub-scanning direction of first surface of cylindrical lens | Rs3 | mm | 26.99300 |
| Radius of curvature in main-scanning direction of first surface of cylindrical lens | Rm3 | mm | ∞ |
| Thickness of cylindrical lens | d3 | mm | 6.00000 |
| Refractive index of cylindrical lens | n3 | | 1.51072 |
| Radius of curvature of second surface of cylindrical lens | R4 | mm | ∞ |
| Distance between second surface of cylindrical lens and aperture stop | d4 | mm | 16.43000 |
| Distance between aperture stop and reflective deflecting facet of polygon mirror | D5 (=L1) | mm | 31.95000 |
| Distance between reflective deflecting facet of polygon mirror and first surface of first fθ lens | d6 | mm | 24.50000 |
| Thickness of first fθ lens | d7 | mm | 8.00000 |
| Refractive index of first fθ lens | n7 | | 1.52420 |
| Distance between second surface of first fθ lens and first surface of second fθ lens | d8 | mm | 15.36871 |
| Thickness of second fθ lens | d9 | mm | 7.00000 |
| Refractive index of second fθ lens | n9 | | 1.52420 |
| Distance between second surface of second fθ lens and surface to be scanned | d10 | mm | 119.08129 |
| Focal length in main-scanning direction of fθ lens | f2 | mm | 136.23663 |
| Angle in sub-scanning section between beam incident on drum and normal to drum | α | deg | 6.00000 |
| Incident angle on polygon mirror of incidence optical system | γ | deg | 60.00000 |
| Focal length of collimator lens | f1 | mm | 24.63640 |
| Radius of circumscribed circle of polygon mirror | R | mm | 20.00000 |
| Maximum scanning angle | η | deg | 45.00000 |
| Number of pixels per inch in main-scanning direction | Nm | | 600 |
| Number of pixels per inch in sub-scanning direction | Ns | | 600 |
| Number of deflecting facets of polygon mirror | men | | 6 |

TABLE 2

| configuration of fθ lens | | | |
|---|---|---|---|
| first surface | | second surface | |
| first fθ lens | | | |
| R | −62.04392 | R | −35.19858 |
| k | −4.61089E+00 | ku | −2.12978E+00 |
| B4 | 2.85204E−06 | B4u | −4.48178E−07 |
| B6 | 0.00000E+00 | B6u | 2.06135E−09 |
| B8 | 0.00000E+00 | B8u | −2.36403E−14 |
| B10 | 0.00000E+00 | B10u | 0.00000E+00 |
| r | −62.04392 | r | −59.17710 |
| D2 | 1.05181E−03 | D2u | −6.23751E−05 |
| D4 | 3.61021E−06 | D4u | −1.98025E−06 |
| D6 | −4.19737E−09 | D6u | 2.96105E−09 |
| D8 | −7.32799E−12 | D8u | 0.00000E+00 |
| D10 | 2.27434E−14 | D10u | 0.00000E+00 |
| | | D21 | −3.52689E−04 |
| | | D41 | −5.64873E−07 |
| | | D61 | 1.90799E−09 |
| | | D81 | 0.00000E+00 |
| | | D101 | 0.00000E+00 |
| second fθ lens | | | |
| R | 88.19567 | R | 86.69997 |
| k | −5.32797E−01 | k | −1.69591E+01 |
| B4 | −4.52682E−06 | B4 | −3.21654E−06 |
| B6 | 2.28022E−09 | B6 | 1.39488E−09 |
| B8 | −7.45817E−13 | B8 | −3.76115E−13 |
| B10 | 8.42430E−17 | B10 | 2.16568E−17 |
| r | −37.27270 | r | −13.92790 |
| D2 | 3.60879E−03 | D2 | 1.26219E−03 |
| D4 | 3.97486E−06 | D4 | −1.11752E−06 |

TABLE 2-continued

| configuration of fθ lens | | | |
|---|---|---|---|
| first surface | | second surface | |
| D6 | 6.17920E−11 | D6 | 6.81607E−10 |
| D8 | −5.22544E−13 | D8 | −2.44767E−13 |
| D10 | 0.00000E+00 | D10 | 3.64930E−17 |

Here, an aspherical configuration of the main-scanning section (i.e., a meridian-line section) of the fθ lens can be written as $$x = \frac{y^2/R}{1+(1-(1+k)(y/R)^2)^{1/2}} + B_4y^4 + B_6y^6 + B_8y^8 + B_{10}y^{10} + B_{12}y^{12} + B_{14}y^{14} \quad \text{(a)}$$

where an origin is the intersection between each lens surface and the optical axis, the X-axis is the optical axial direction, the Y-axis is an axis orthogonal to the optical axis in the main-scanning section, the Z-axis is an axis orthogonal to the optical axis in the sub-scanning section, R is a paraxial radius of curvature, and k and $B_4$ to $B_{10}$ are aspherical coefficients, respectively.

On the other hand, a configuration in the sub-scanning section (i.e., a meridional section) has a shape given by $$r' = r(1+D_2y^2+D_4y^4+D_6y^6+D_8y^8+D_{10}y^{10}) \quad \text{(b)}$$

where r' is a radius of curvature of this shape in a section perpendicular to a generating-line aspherical surface at a position whose ordinate of a lens surface in the main-scanning direction is y, r is a radius of curvature on the optical axis, and $D_2$ to $D_{10}$ are coefficients, respectively. In that shape, the radius of curvature of the meridional section continuously changes in accordance with a position in a longitudinal direction of the lens.

Here, where each coefficient varies depending on a value (negative or positive) of y, the radius of curvature is calculated using coefficients $D_{2u}$ to $D_{10u}$ with suffix u when the value of y is positive, and the radius r' of curvature is calculated using coefficients $D_{2i}$ to $D_{10i}$ with suffix i when the value of y is negative.

Figure 6:
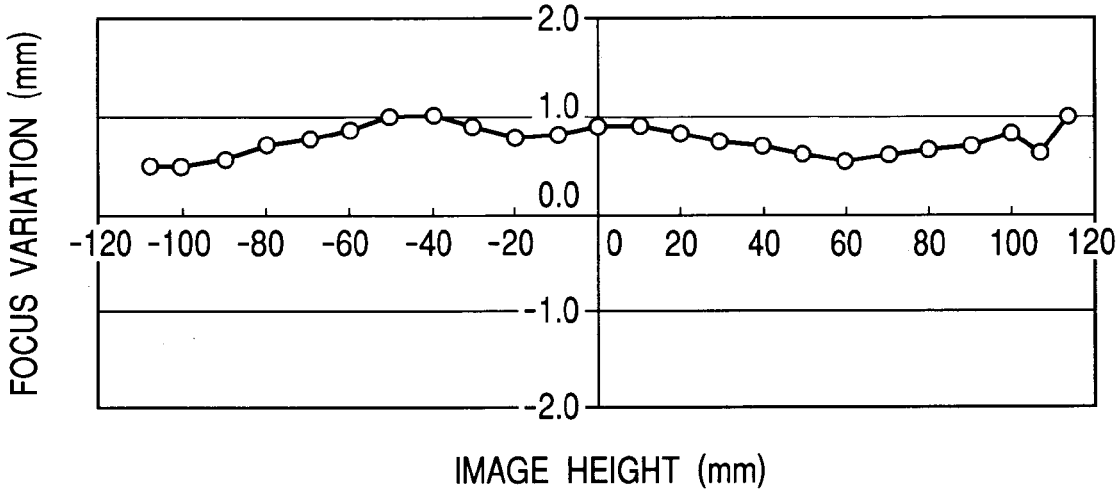
FIG. 6 is a view illustrating a focus displacement amount or focus variation amount $\delta M_{(\beta)}$ in the first embodiment according to the present invention.

FIG. 6 is a graph in which the main-scanning focus displacement amount $\delta M_{(\beta)}$ at the scanning location of the average β is plotted with its abscissa being an image height (mm), where β is the average of angles formed between the principal rays of the three light beams incident at any scanning location on the photosensitive drum surface 7 and the normal to the photosensitive drum surface 7 in the main-scanning section. Here, the image height 114.1 mm at the right end of the graph indicates an image height for the BD detection, and the focus displacement amount at this position is $\delta M_{(BD)}$ whose amount is 0.99047 mm.

Figure 7:
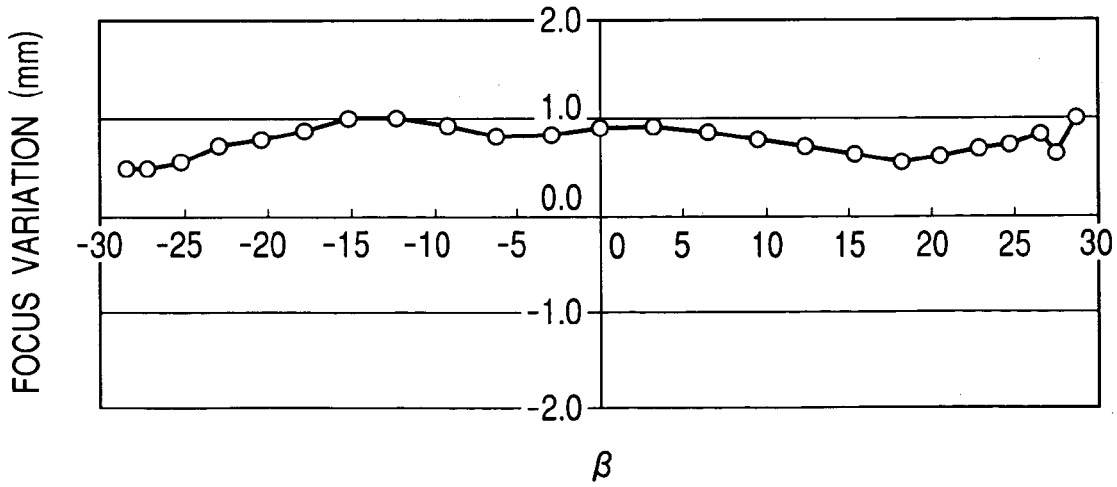
FIG. 7 is a view illustrating a focus displacement amount or focus variation amount $\delta M_{(\beta)}$ in the first embodiment according to the present invention.

FIG. 7 is a similar graph whose abscissa represents the average β of angles formed between the principal rays of the three light beams incident at any scanning location on the photosensitive drum surface 7 and the normal to the photosensitive drum surface 7 in the main-scanning section. Here, the angle β of 28.78 degrees at the right end of the graph indicates the image height for the BD detection, and the focus displacement amount at this position is $\delta M_{(BD)}$ whose amount is 0.99047 mm.

FIG. 8 shows numerical data of the first embodiment, such as the scanning image height of the light beam on the photosensitive drum surface 7, the average β of angles formed between the principal rays of the three light beams incident at any scanning location on the photosensitive drum surface 7 and the normal to the photosensitive drum surface 7 in the main-scanning section, the above-described $\delta M_{(\beta)}$, and so forth.

Figure 9:
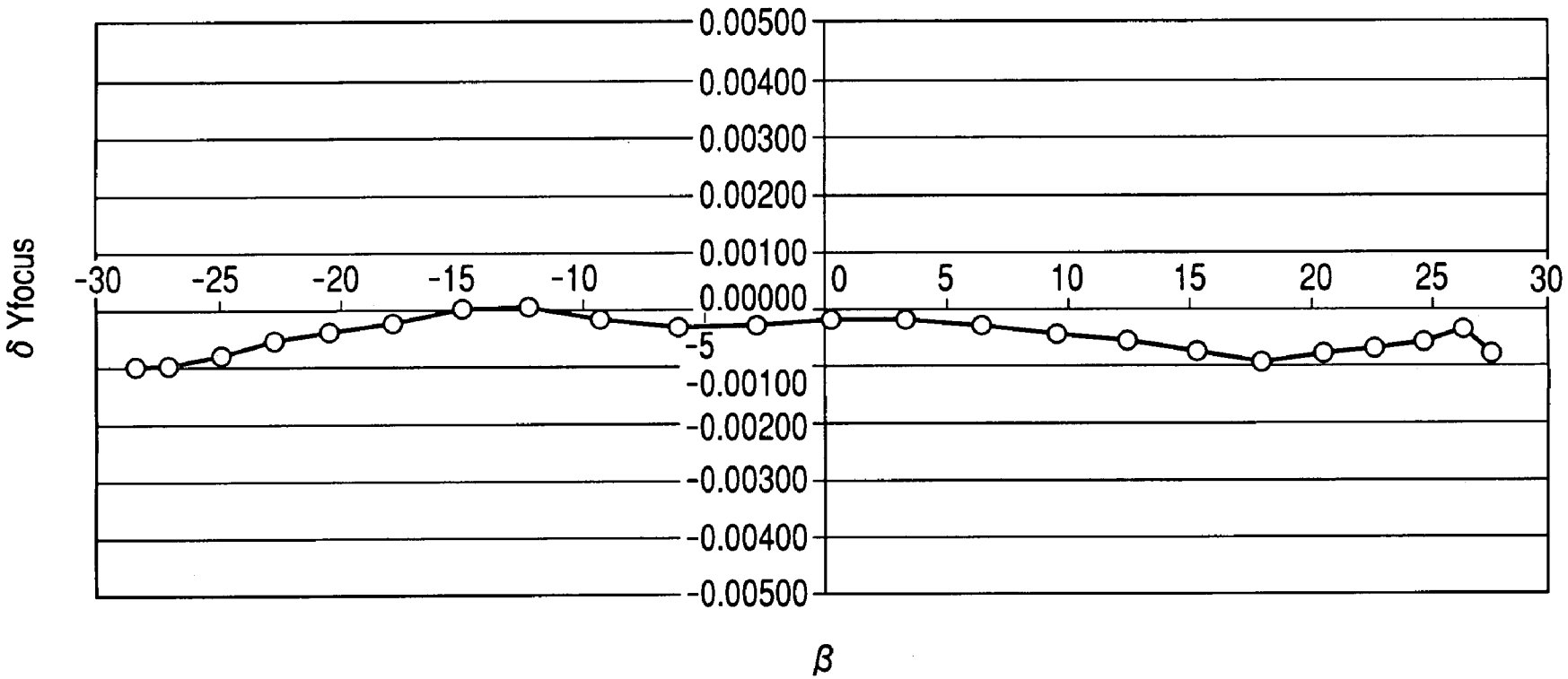
FIG. 9 is a graph in which a displacement amount or variation amount $\delta Y_{focus}$ in the first embodiment according to the present invention is plotted with β being its abscissa.

FIG. 9 is a graph of the first embodiment, whose abscissa is β, and whose ordinate is the value of the formula (3), i.e., the displacement amount $\delta Y_{focus}$ of the image location in the main-scanning direction in the effective scanning region on the photosensitive drum surface 7 for image recording.

In the first embodiment, the number of the plural light emitting portions is three (3), the average α of angles formed between the principal rays of the three light beams incident on the photosensitive drum surface 7 and the normal to the photosensitive drum surface 7 in the sub-scanning section is 6 (six) degrees, and the number $N_S$ of pixels per inch in the sub-scanning direction which is determined from the resolution in the sub-scanning direction on the photosensitive drum surface 7 is 600.

Figure 10:
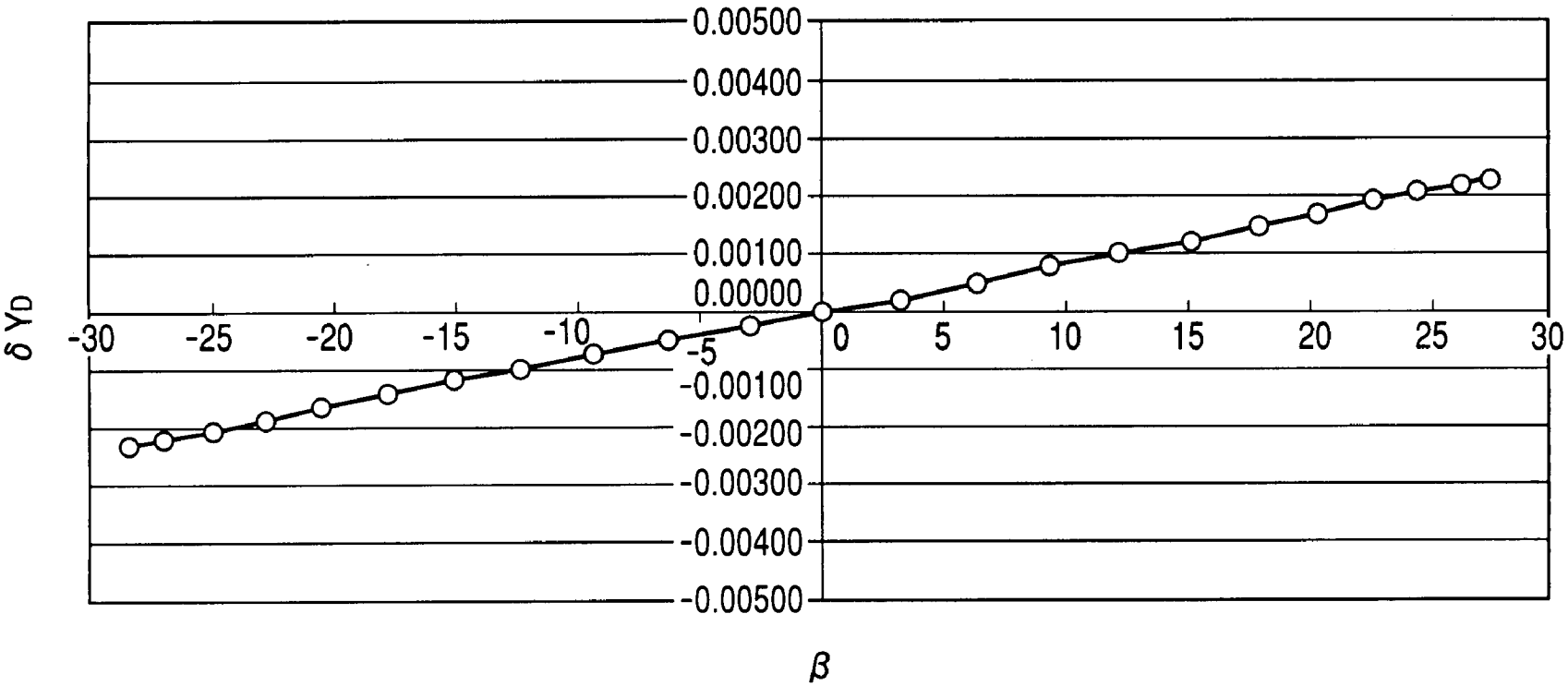
FIG. 10 is a graph in which a displacement amount or variation amount $\delta Y_D$ in the first embodiment according to the present invention is plotted with β being its abscissa.

FIG. 10 is a graph of that case, whose abscissa is β, and whose ordinate is the value of the formula (5), i.e., the displacement amount $\delta Y_D$ of the image location in the main-scanning direction in the effective scanning region, which occurs when the average of the angles formed between the principal rays of the three light beams incident on the photosensitive drum surface 7 and the normal to the photosensitive drum surface 7 in the sub-scanning section takes a predetermined non-zero angle a.

The absolute value of a sum of the displacement amounts of the image location in the main-scanning direction shown in FIGS. 9 and 10 is written on the left-hand side of the condition or formula (6) written as $$|\delta Y| = \left| P\sin\alpha\tan\beta + \frac{S_1 L_1}{f_1 f_2}(\delta M_{(\beta)} - \delta M_{(BD)}) \right|$$

Figure 11:
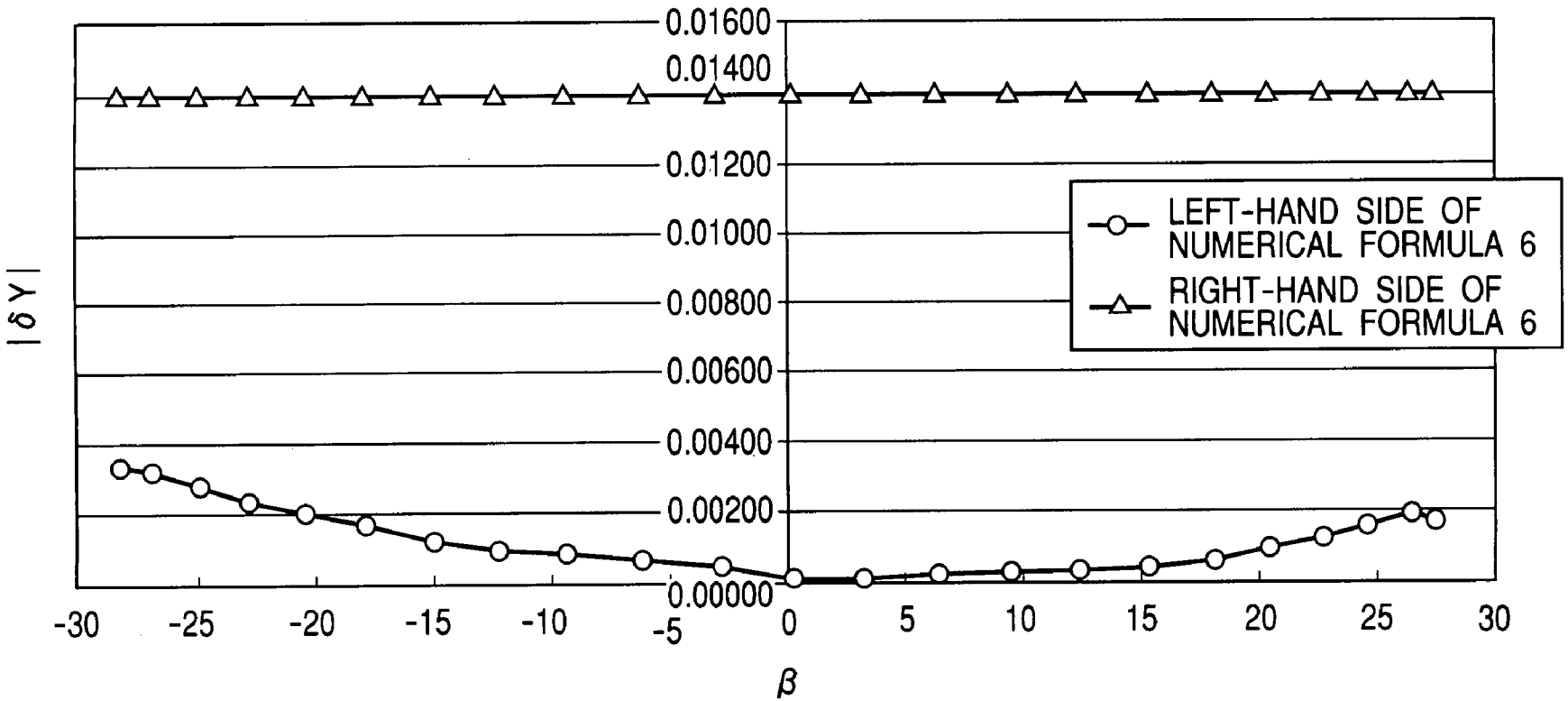
FIG. 11 is a graph in which a displacement amount or variation amount δY of a sum of displacement amounts in FIGS. 9 and 10 is plotted with β being its abscissa.

FIG. 11 is a graph in which this amount and the value $25.4/3N_M$ of the right-hand side of that formula are plotted with its abscissa being β.

In the first embodiment, it is possible to effectively oppress the displacement amount of the image location in the main-scanning direction in the effective scanning region on the photosensitive drum surface 7 for image recording when the condition (6) is satisfied, as shown in FIG. 11, thereby achieving a multi-beam optical scanning apparatus suitably usable in a high-speed and high-image-quality application.

In the first embodiment, a light source unit including at least three light emitting portions is used as the light source unit to be adaptable to a high-speed application. When the number of the light emitting portions is increased, such a construction becomes more advantageous for a higher-speed application. However, since characteristics, such as droop cross-talk, are likely to decrease in the monolithic multi-beam semiconductor laser used in this embodiment if the spacing between the light emitting portions is made short, the spacing between the light emitting portions is normally set to about 0.1 mm presently. Accordingly, as the number of the light emitting portions increases, the value of the above-discussed $S_1$ increases, and accordingly the amounts $\delta Y_{focus}$ and $\delta Y_D$ are likely to increase, i.e., the displacement amount of the image location in the main-scanning direction in the effective scanning region is likely to increase. It is thus difficult to obtain an image output with a high image quality. In the first embodiment, however, the displacement or variation of the image location of the light beam is reduced by satisfying the above-discussed condition or formula (6), and an image with a high image quality is hence achieved. The formula (6) is an important condition for obtaining an image output with a high image quality especially in the event that the number of the light emitting portions is equal to or more than three.

In the first embodiment, description has been made to the construction wherein the BD slit 9 is disposed in front of the BD lens 10, but the BD slit 9 is not necessarily disposed, and the BD lens 10 can be omitted. The BD sensor 11 serving as the writing start position synchronous signal detecting device can be directly disposed at a location of the BD slit 9, i.e., an image location of each light beam (this location is equivalent to the place of the photosensitive drum surface 7). In such a case, an edge of an end portion of a sensor surface (a light receiving face) of the BD sensor 11 naturally has the same function as the BD slit 9.

(Second Embodiment)

Figure 12:
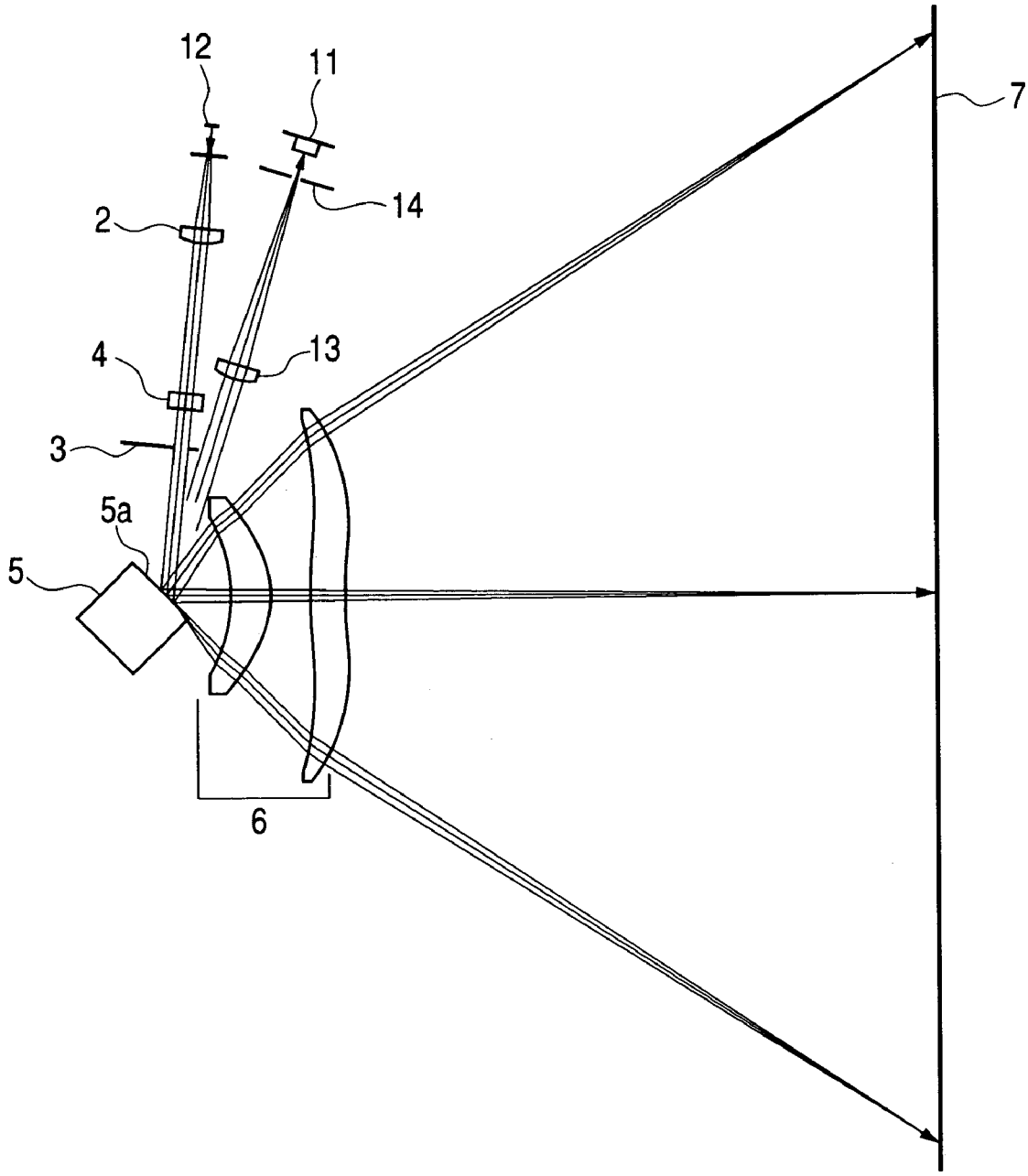
FIG. 12 is a cross-sectional view in the main-scanning section illustrating a second embodiment according to the present invention.

FIG. 12 is a cross-sectional view in the main-scanning direction illustrating a multi-beam optical scanning apparatus of a second embodiment according to the present invention. In FIG. 12, like reference characters designate the same elements as those illustrated in FIG. 1.

The second embodiment is different from the first embodiment in that the displacement or variation of the image location of each of light beams emitted from light emitting portions 1*a*, 1*b* and 1*c* is reduced by satisfying a condition or formula (11) described later in a construction in which a light source unit 12 is comprised of the three light emitting portions 1*a*, 1*b* and 1*c*, and a writing start position synchronous signal detecting unit is comprised of a BD lens 13, a BD slit 14, a BD sensor 11, and the like. Other structure and optical function of the second embodiment are approximately the same as those of the first embodiment, thereby achieving the same technical advantages.

In FIG. 12, reference numeral 12 represents the light source unit comprised of the three light emitting or radiation portions 1*a*, 1*b* and 1*c* spaced from each other in both the main-scanning direction and the sub-scanning direction. More specifically, the light source unit 12 is comprised of, for example, a multi-beam semiconductor laser. In FIG. 12, however, depiction of the three light emitting portions 1*a*, 1*b* and 1*c* are omitted for the convenience of simplicity. The above light source unit can be replaced by a light source unit including four or more than four light emitting portions.

Reference numeral 13 represents an imaging lens (the BD lens) for synchronous detection, which serves as a third optical system, and guides a BD light beam reflected by the optical deflector 5 to the BD sensor 11. Reference numeral 14 represents a slit member (the BD slit) which is disposed at an image location of the BD lens 13, or at a location in its vicinity.

In the multi-beam optical scanning apparatus of the second embodiment, a light beam (a BD light beam) for detection of the writing start position synchronous signal for detecting the timing of the scanning start position on the photosensitive drum surface 7 does not pass through the fθ lens 6, and instead passes through the separately-provided BD lens 13 for guiding the BD light beam to the BD sensor 11 such that the BD detection can be executed, differently from the first embodiment. The BD lens 13 is comprised of an anamorphic lens such that an image of the light beam reflected by the deflecting facet 5*a* can be formed on the location of the BD slit 14 in the main-scanning section, and a conjugate relationship between the deflecting facet 5*a* and the BD slit 14 can be established in the sub-scanning section.

Since the BD light beam passes through the separately-provided BD lens 13 different from the fθ lens 6 in the multi-beam optical scanning apparatus of the second embodiment, it can be readily understood that the displacement amount $\delta Y_{focus}$ of the image location in the main scanning direction does not become zero even if the main-scanning focus displacement δM in the effective scanning region on the photosensitive drum surface 7 for image recording has the same amount as the main-scanning focus displacement $\delta M_{(BD)}$ at the location of the BD detection.

In the second embodiment, similarly to the first embodiment, where $\delta M_{(\beta)}$ is the main-scanning focus displacement amount at any scanning location whereat the average of angles formed between principal rays of the three light beams incident on the photosensitive drum surface 7 and the normal to the photosensitive drum surface 7 in the effective scanning region on the photosensitive drum surface 7 for image recording is β, the displacement or variation amount $\delta Y_1$ of the image location in the main-scanning direction on the photosensitive drum surface 7 for each light beam emitted from each of the light emitting portions 1*a*, 1*b* and 1*c* in this instance is given by $$\delta Y_1 = \frac{S_1 L_1}{f_1 f_2} \delta M_{(\beta)} \tag{7}$$

Further, similarly, where $\delta M_{(BD)}$ is the main-scanning focus displacement amount at the scanning location whereat each light beam passes through the BD slit 9, and $f_3$ is the focal length of the BD lens 13 in the main-scanning direction, the displacement amount $\delta Y_{BD}$ of the image location in the main-scanning direction on the BD slit 9 for each of the light beams emitted from the light emitting portions 1*a*, 1*b* and 1*c* in this instance is given by $$\delta Y_{BD} = \frac{S_1 L_1}{f_1 f_3} \delta M_{(BD)} \tag{8}$$

Accordingly, in the second embodiment, similarly to the first embodiment, the displacement amount $\delta Y_{focus}$ of the image location in the main-scanning direction in the effective scanning region on the photosensitive drum surface 7 for image recording is written as $$\delta Y_{focus} = \delta Y_1 - \delta Y_{BD} = \frac{S_1 L_1}{f_1 f_2} \delta M_{(\beta)} - \frac{S_1 L_1}{f_1 f_3} \delta M_{(BD)} \tag{9}$$

where $S_1$ is the spacing in the main-scanning direction between the light emitting portions at opposite ends in the at least three light emitting portions 1*a*, 1*b* and 1*c*, $f_1$ is the focal length of the collimator lens 2, $L_1$ is the distance between the stop 3 and the deflecting facet 5*a* of the optical deflector 5, $f_2$ is the focal length of the fθ lens 6 in the main-scanning direction, $f_3$ is the focal length of the BD lens 13 in the main-scanning direction, $\delta M_{(\beta)}$ is the main-scanning focus displacement amount at the scanning location whereat the average of angles formed between principal rays of the three light beams incident at any scanning location on the photosensitive drum surface 7 and the normal to the photosensitive drum surface 7 in the main-scanning section is β, and $\delta M_{(BD)}$ is the main-scanning focus displacement amount at the scanning location whereat the three light beams pass through the slit 9.

In the second embodiment, it can be readily understood from the formula (9) that even if the main-scanning focus displacement amount $\delta M_{(\beta)}$ in the effective scanning region on the photosensitive drum surface 7 for image recording has the same amount as the main-scanning focus displacement amount $\delta M_{(BD)}$ at the location of the BD detection, the displacement amount $\delta Y_{focus}$ of the image location in the main-scanning direction does not become zero.

Further, similarly to the first embodiment, the displacement amount $\delta Y_D$ in the main-scanning, which occurs due to the average α of angles formed between principal rays of the three light beams incident on the photosensitive drum surface 7 and the normal to the photosensitive drum surface 7 in the sub-scanning section, is given by $$\delta Y_D = P \sin \alpha \tan \beta \tag{10}$$

Accordingly, the absolute value of the total displacement amount δY of the image location in the main-scanning direction on the photosensitive drum surface 7 in the second embodiment is the amount of a sum of $\delta Y_{focus}$ represented by the formula (9) and $\delta Y_D$ represented by the formula (10), and can be written as $$|\delta Y| = \left| \frac{S_1 L_1}{f_1 f_2} \delta M_{(\beta)} - \frac{S_1 L_1}{f_1 f_3} \delta M_{(BD)} + P \sin\alpha \tan\beta \right|$$

In general, the positional displacement or variation of the image point in the main-scanning direction begins to be readily discernible when it exceeds ⅓ of the pixel pitch per one inch (25.4 mm) in the main-scanning direction which is determined from the resolution in the main-scanning direction on the photosensitive drum surface 7, and influence of the positional displacement on the image becomes unable to neglect.

Therefore, the above δY needs to satisfy the following condition (11)

$$|\delta Y| = \left| P\sin\alpha\tan\beta + \frac{S_1 L_1}{f_1 f_2}\delta M_{(\beta)} - \frac{S_1 L_1}{f_1 f_3}\delta M_{(BD)} \right| \leq \frac{25.4}{3N_M} \quad (11)$$

where $N_M$ is the number of pixels per inch in the main-scanning direction which is determined from the resolution in the main-scanning direction on the photosensitive drum surface 7.

In the second embodiment, values of $S_1$, $f_1$, $L_1$, $f_2$, $f_3$, α, β, $\delta M_{(\beta)}$ and $\delta M_{(BD)}$ are appropriately designed so as to satisfy the formula (11), depending on $N_M$ and P, where $S_1$ is the spacing in the main-scanning direction between the light emitting portions at opposite ends in the three or more than three light emitting portions 1*a*, 1*b* and 1*c*, $f_1$ is the focal length of the collimator lens 2, $L_1$ is the distance between the stop 3 and the deflecting facet 5*a* of the optical deflector 5, $f_2$ is the focal length of the fθ lens 6 in the main-scanning direction, $f_3$ is the focal length of the BD lens 13 in the main-scanning direction, α is the average of angles formed between the principal rays of the three light beams incident on the photosensitive drum surface 7 and the normal to the photosensitive drum surface 7 in the sub-scanning section, β is the average of angles formed between the principal rays of the three light beams incident at any scanning location on the photosensitive drum surface 7 and the normal to the photosensitive drum surface 7 in the main-scanning section, $\delta M_{(\beta)}$ is the main-scanning focus displacement amount at the scanning location of the average β, $\delta M_{(BD)}$ is the main-scanning focus displacement amount at the scanning location whereat the three light beams pass through the slit 14, $N_M$ is the number of pixels per inch in the main-scanning direction which is determined from the resolution in the main-scanning direction on the photosensitive drum surface 7, and P is the spacing in the sub-scanning direction between image spots of the light beams emitted from the three light emitting portions 1*a*, 1*b* and 1*c* on the photosensitive drum surface 7.

Consequently, the displacement amount of the image location in the main-scanning direction in the effective scanning region on the photosensitive drum surface 7 for image recording can be effectively oppressed, thereby achieving a multi-beam optical scanning apparatus suitable for a high-speed and high-image-quality application.

Tables 3 and 4 show characteristics of the multi-beam optical scanning apparatus of the second embodiment.

TABLE 3

| | | | |
|---|---|---|---|
| Reference wavelength used | Λ | Nm | 780 |
| Number of light emitting points | N | | 3 |
| Spacing between light emitting points | 1 | mm | 0.05000 |
| Spacing between light emitting points at opposite ends | S1 | mm | 0.10000 |
| Thickness of cover glass for semiconductor laser | dcg | mm | 0.25000 |
| Refractive index of cover glass for semiconductor laser | N0 | | 1.51072 |
| Distance between light emitting point and first surface Of collimator lens | d0 | mm | 18.33000 |
| Radius of curvature of first surface of collimator lens | R1 | mm | ∞ |
| Thickness of collimator lens | d1 | mm | 3.00000 |
| Refractive index of collimator lens | n1 | | 1.76203 |
| Radius of curvature of second surface of collimator lens | R2 | mm | −15.21639 |
| Distance between first surface of collimator lens and first surface of cylindrical lens | d2 | mm | 29.38200 |
| Radius of curvature in sub-scanning direction of first surface of cylindrical lens | Rs3 | mm | 19.21300 |
| Radius of curvature in main-scanning direction of first surface of cylindrical lens | Rm3 | mm | ∞ |
| Thickness of cylindrical lens | d3 | mm | 3.00000 |
| Refractive index of cylindrical lens | n3 | | 1.52420 |
| Radius of curvature of second surface of cylindrical lens | R4 | mm | ∞ |
| Distance between second surface of cylindrical lens and aperture stop | d4 | mm | 7.19000 |
| Distance between aperture stop and reflective deflecting facet of polygon mirror | d5 (=L1) | mm | 28.36000 |
| Distance between reflective deflecting facet of polygon mirror and first surface of first fθ lens | d6 | mm | 10.50000 |
| Thickness of first fθ lens | d7 | mm | 6.50000 |
| Refractive index of first fθ lens | n7 | | 1.52420 |
| Distance between second surface of first fθ lens and first surface of second fθ lens | d8 | mm | 7.12000 |
| Thickness of second fθ lens | d9 | mm | 6.60000 |
| Refractive index of second fθ lens | n9 | | 1.52420 |
| Distance between second surface of second fθ lens and surface to be scanned | d10 | mm | 103.28000 |
| Focal length in main-scanning direction of fθ lens | f2 | mm | 109.00000 |
| Angle in sub-scanning section between beam incident on drum and normal to drum | α | deg | 10.00000 |
| Incident angle on polygon mirror of incidence optical system | γ | deg | 85.00000 |

TABLE 3-continued

| | | | |
|---|---|---|---|
| Focal length of collimator lens | f1 | mm | 19.96823 |
| Focal length in main-scanning direction of BD lens | f3 | mm | 42.71700 |
| Radius of circumscribed circle of polygon mirror | r | mm | 10.00000 |
| Maximum scanning angle | η | deg | 56.24448 |
| Number of pixels per inch in main-scanning direction | Nm | | 600 |
| Number of pixels per inch in sub-scanning direction | Ns | | 600 |
| Number of deflecting facets of polygon mirror | men | | 4 |

TABLE 4

| configuration of fθ lens | | | |
|---|---|---|---|
| first surface | | second surface | |
| first fθ lens | | | |
| R | −26.48140 | R | −19.75260 |
| k | −1.49902E+00 | k | −8.11549E−01 |
| B4 | 2.62745E−05 | B4 | 1.30249E−05 |
| B6 | −5.63823E−08 | B6 | 3.59039E−03 |
| B8 | 0.00000E+00 | B8 | −9.03558E−11 |
| B10 | 0.00000E+00 | B10 | 0.00000E+00 |
| r | −11.60330 | r | −29.99770 |
| D2u | 1.66782E−02 | D2u | 4.74335E−02 |
| D4u | −2.05511E−05 | D4u | −7.89235E−04 |
| D6u | 0.00000E+00 | D6u | 5.72932E−06 |
| D8u | 0.00000E+00 | D8u | −9.37297E−09 |
| D10u | 0.00000E+00 | D10u | 0.00000E+00 |
| D21 | −9.72676E−05 | D21 | −1.03896E−02 |
| D41 | −7.39144E−06 | D41 | 8.82172E−05 |
| D61 | 0.00000E+00 | D61 | −3.60050E−07 |
| D81 | 0.00000E+00 | D81 | 5.30588E−10 |
| D101 | 0.00000E+00 | D101 | 0.00000E7+00 |
| second fθ lens | | | |
| R | 84.79910 | R | 82.56960 |
| k | −8.42997E+00 | k | −8.26049E−01 |
| B4u | −1.54001E−05 | B4u | −2.19243E−05 |
| B6u | 1.37412E−08 | B6u | 2.45322E−08 |
| B8u | −2.69944E−12 | B8u | −2.67301E−11 |
| B10u | −2.15513E−15 | B10u | 2.10166E−14 |
| B12u | 7.93243E−19 | B12u | −8.35950E−18 |
| B14u | 0.00000E+00 | B14u | 1.04822E−21 |
| B41 | −1.71719E−05 | B41 | −2.31502E−05 |
| B61 | 1.72463E−08 | B61 | 2.67547E−08 |
| B81 | −4.67025E−12 | B81 | −2.92126E−11 |
| B101 | −1.99776E−15 | B101 | 2.29436E−14 |
| B121 | 7.71718E−19 | B121 | −8.50899E−18 |
| B141 | 0.00000E+00 | B141 | 6.12529E−22 |
| r | −78.88030 | r | −10.05710 |
| D2u | 4.13213E−02 | D2u | 1.77203E−03 |
| D4u | −3.82144E−05 | D4u | −4.56816E−06 |
| D6u | −1.21474E−08 | D6u | 6.29186E−09 |
| D8u | 2.14803E−11 | D8u | −4.13362E−12 |
| D10u | 0.00000E+00 | D10u | 1.05481E−15 |
| D21 | 0.00000E+00 | | |
| D41 | 0.00000E+00 | | |
| D61 | 0.00000E+00 | | |
| D81 | 0.00000E+00 | | |
| D101 | 0.00000E+00 | | |

Here, an aspherical configuration of the main-scanning section (i.e., the meridian-line section) and a configuration of the sub-scanning section (i.e., the sagittal-line section) of the fθ lens in the second embodiment can be represented by the above-described formulae (a) and (b).

Figure 13:
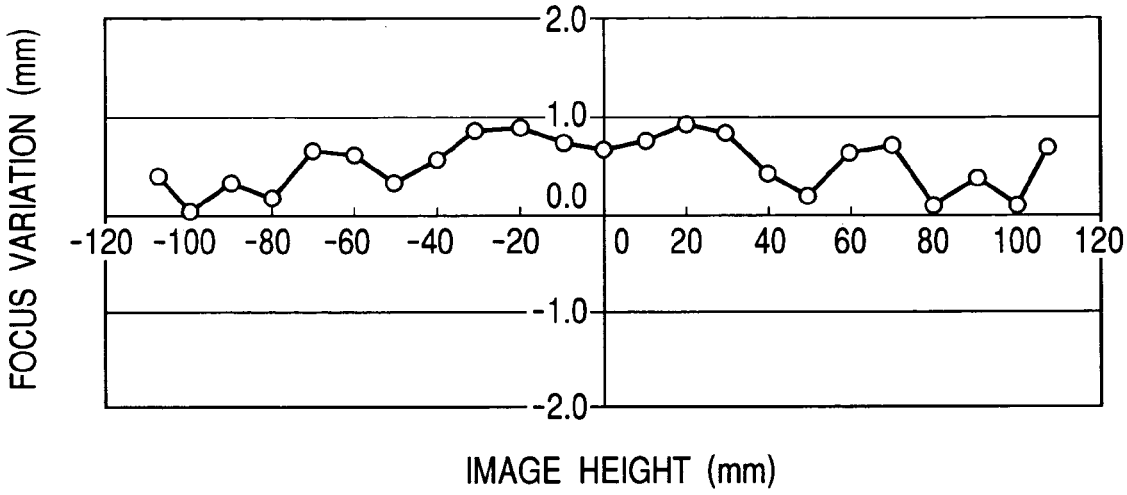
FIG. 13 is a view illustrating a focus displacement amount or focus variation amount $\delta M_{(\beta)}$ in the second embodiment according to the present invention.

FIG. 13 is a graph of the second embodiment in which the main-scanning focus displacement amount $\delta M_{(\beta)}$ at the scanning location of the average β is plotted with its abscissa being an image height (mm), where β is the average of angles formed between the principal rays of the three light beams incident at any scanning location on the photosensitive drum surface 7 and the normal to the photosensitive drum surface 7 in the main-scanning section.

Figure 14:
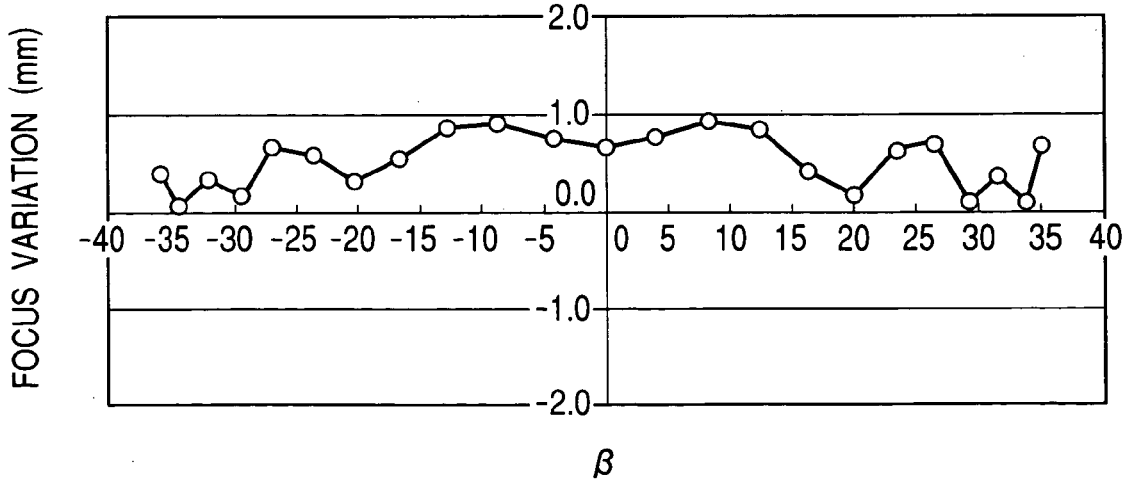
FIG. 14 is a view illustrating a focus displacement amount or focus variation amount $\delta M_{(\beta)}$ in the second embodiment according to the present invention.

FIG. 14 is a similar graph whose abscissa represents the average β of angles formed between the principal rays of the three light beams incident at any scanning location on the photosensitive drum surface 7 and the normal to the photosensitive drum surface 7 in the main-scanning section.

FIG. 15 shows numerical data of the second embodiment, such as the scanning image height of the light beam on the photosensitive drum surface 7, the average β of angles formed between the principal rays of the three light beams incident at any scanning location on the photosensitive drum surface 7 and the normal to the photosensitive drum surface 7 in the main-scanning section, the above-described $\delta M_{(\beta)}$, and so forth.

Further, in the BD detection, the reflective angle of the BD light beam reflected by the deflecting facet 5*a* of the optical deflector 5 is set to 75 degrees, and the focus displacement amount $\delta M_{(BD)}$ in this instance is 0.3 mm.

Figure 16:
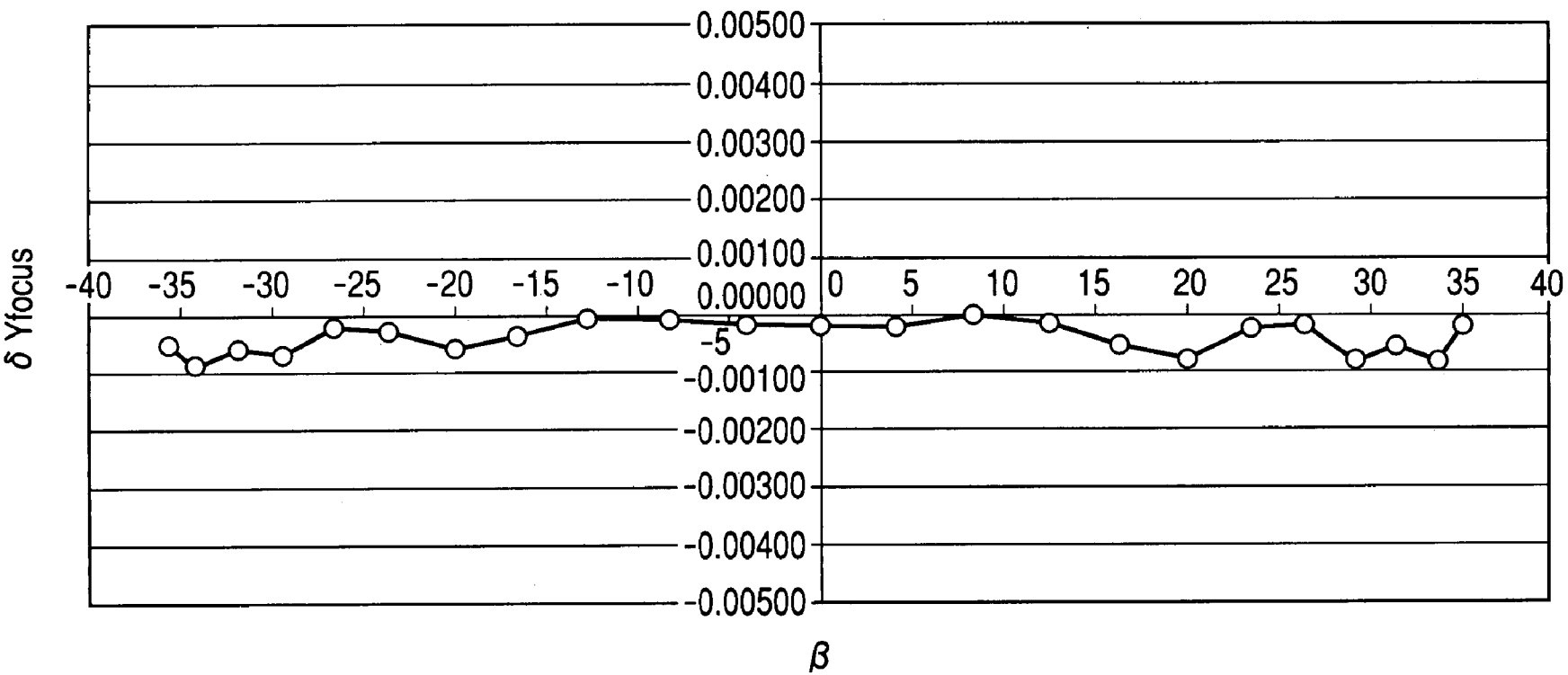
FIG. 16 is a graph in which a displacement amount or variation amount $\delta Y_{focus}$ in the second embodiment according to the present invention is plotted with β being its abscissa.

FIG. 16 is a graph of the second embodiment, whose abscissa is β, and whose ordinate is the value of the formula (9), i.e., the displacement amount $\delta Y_{focus}$ of the image location in the main-scanning direction in the effective scanning region on the photosensitive drum surface 7 for image recording.

In the second embodiment, the number of the plural light emitting portions is three (3), the average α of angles formed between the principal rays of the three light beams incident on the photosensitive drum surface 7 and the normal to the photosensitive drum surface 7 in the sub-scanning section is 10 (ten) degrees, and the number $N_S$ of pixels per inch in the sub-scanning direction which is determined from the resolution in the sub-scanning direction on the photosensitive drum surface 7 is 600.

Figure 17:
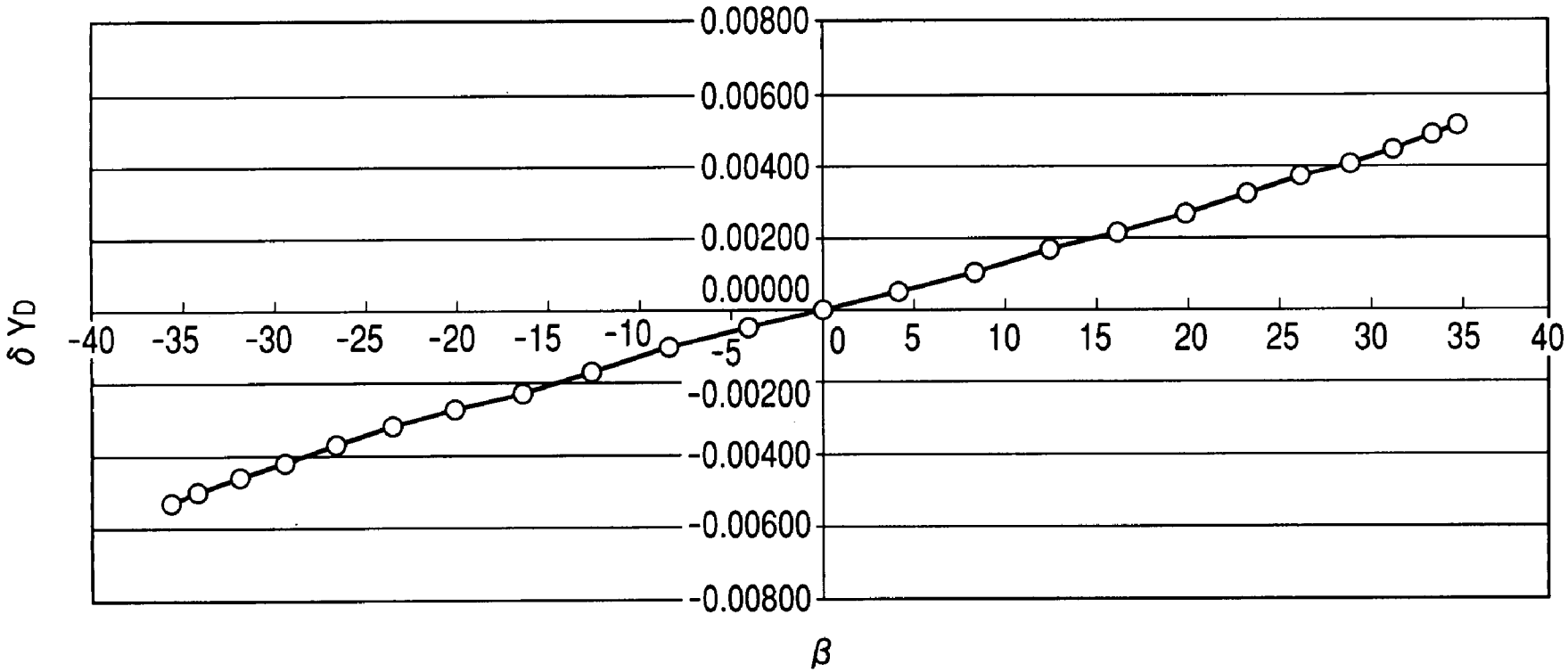
FIG. 17 is a graph in which a displacement amount or variation amount $\delta Y_D$ in the second embodiment according to the present invention is plotted with β being its abscissa.

FIG. 17 is a graph of this structure, whose abscissa is β, and whose ordinate is the value of the formula (10), i.e., the displacement amount $\delta Y_D$ of the image location in the main-scanning direction in the effective scanning region, which occurs when the angle formed between the principal rays of the three light beams incident on the photosensitive drum surface 7 and the normal to the photosensitive drum surface 7 in the sub-scanning section takes a predetermined non-zero angle α.

The absolute value of a sum of the displacement amounts of the image locations in the main-scanning direction shown in FIGS. 16 and 17 is the value on the left-hand side of the condition or formula (11) written as $$|\delta Y| = \left|\frac{S_1 L_1}{f_1 f_2}\delta M_{(\beta)} - \frac{S_1 L_1}{f_1 f_3}\delta M_{(BD)} + P\sin\alpha\tan\beta\right|$$

Figure 18:
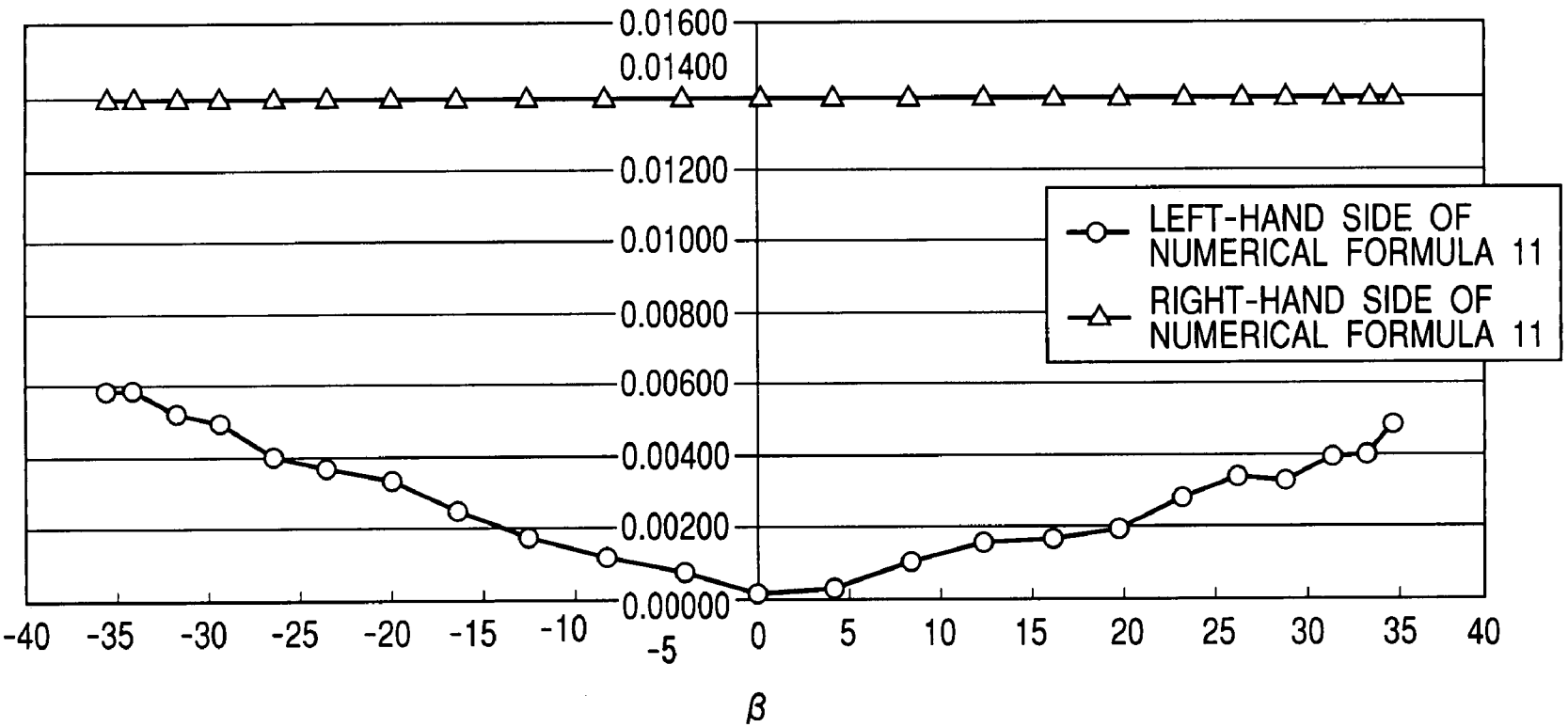
FIG. 18 is a graph in which a displacement amount or variation amount δY of a sum of displacement amounts of image positions in the main-scanning direction in FIGS. 16 and 17 is plotted with $25.4/3N_M$ being its abscissa.

FIG. 18 is a graph in which this amount and the value $25.4/3N_M$ on the right-hand side of that formula are plotted with its abscissa being β.

In the second embodiment, it is possible to effectively oppress the displacement amount δY of the image location in the main-scanning direction in the effective scanning region on the photosensitive drum surface 7 for image recording when the condition (11) is satisfied, as shown in FIG. 18, thereby achieving a multi-beam optical scanning apparatus suitably usable in a high-speed and high-image-quality application.

In the second embodiment, description has been made to the construction wherein the BD slit 14 is disposed in front of the BD sensor 11, but the BD slit 14 is not necessarily disposed, and can be omitted. The BD sensor 11 serving as the writing start position synchronous signal detecting device can be directly disposed at the location of the BD slit 14, i.e., at the image location of each light beam (this location is equivalent to the place of the photosensitive drum surface 7). In such a case, an edge of an end portion of a sensor surface (a light receiving face) of the BD sensor 11 naturally has the same function as the BD slit 14.

In the above-discussed first and second embodiments, description has been made to the construction in which a single multi-beam monolithic semiconductor laser is used as the light source unit 1 or 12. The present invention is, however, not limited to such a structure, and is also applicable to a construction in which a plurality of multi-beam semiconductor lasers are used, and composition of the beams is performed using a beam compounding prism or the like, for example. In such a case, it is natural that the spacing $S_1$ in the main-scanning direction between the light emitting portions 1*a* and 1*c* at opposite ends takes a value of $S_1$ of a case where the light emitting portions are present at a virtual-image location prior to the composition of the light beams from the respective multi-beam semiconductor lasers by the beam compounding prism.

Further, as the monolithic semiconductor laser, the present invention can also employ an edge emitting semiconductor laser, or a surface emitting semiconductor laser in which light emitting portions are arranged in a two-dimensional manner with being spaced from each other both in the main-scanning direction and the sub-scanning direction.

Furthermore, the imaging optical system 6 serving as the second optical system having the fθ characteristic is composed of two lenses of the first and second fθ lenses 6*a* and 6*b* in the above embodiments, but this imaging optical system 6 is not limited to this construction. For example, the imaging optical system 6 can be composed of a single lens, three or more than three lenses, or a combination of the lens and a curved mirror or a diffractive optical element.

(Third Embodiment)

Figure 19:
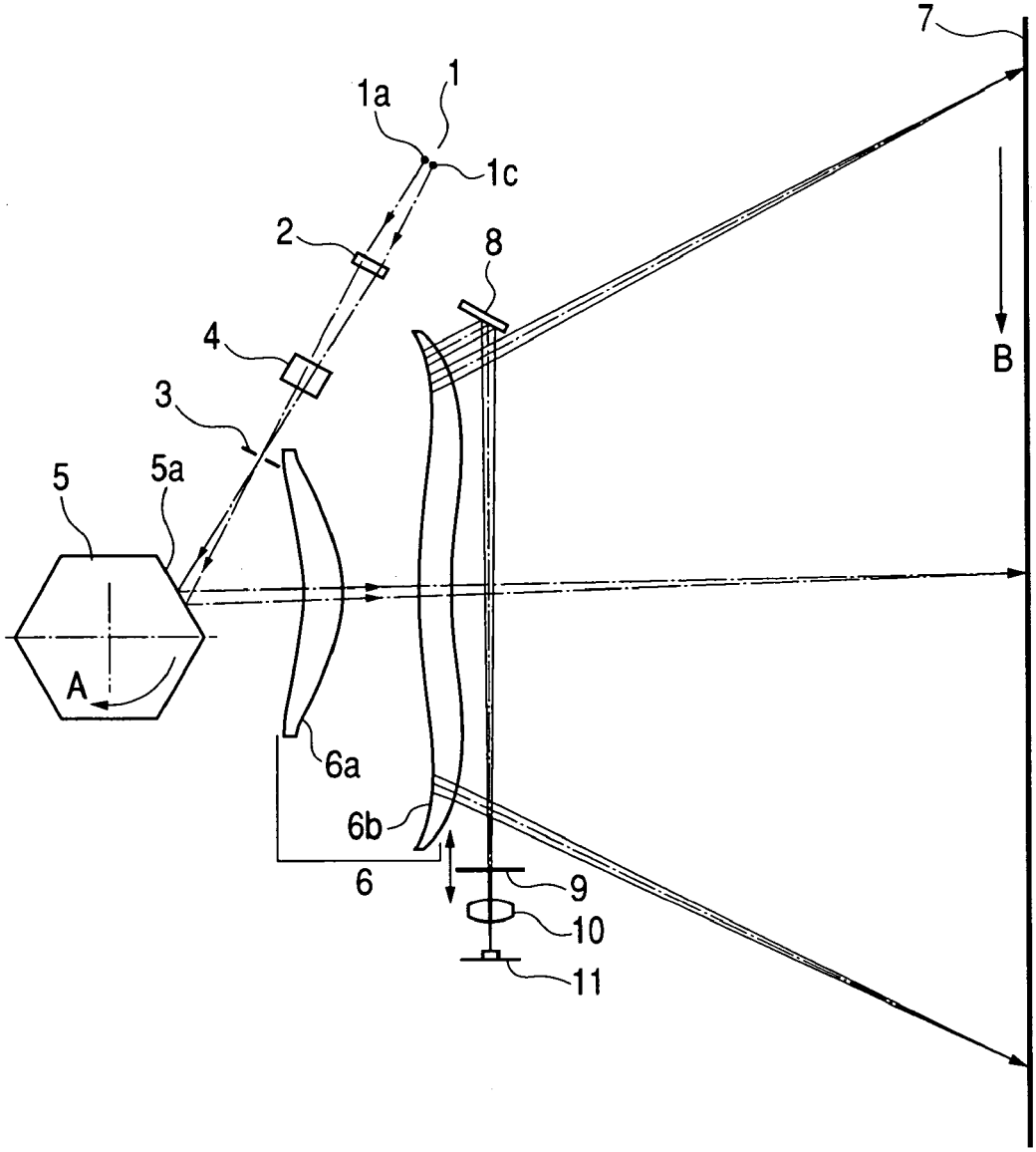
FIG. 19 is a cross-sectional view in the main-scanning section illustrating a third embodiment according to the present invention.

FIG. 19 is a cross-sectional view in the main-scanning direction illustrating a multi-beam optical scanning apparatus of a third embodiment according to the present invention. In FIG. 19, like reference characters designate the same elements as those illustrated in FIG. 1.

The third embodiment is different from the first embodiment in that a BD slit 19 is adapted to be movable along a direction in which plural light beams incident on the BD slit 19 travel. Other structure and optical function of the third embodiment are approximately the same as those of the first embodiment, thereby obtaining similar technical advantages.

In FIG. 19, reference numeral 19 designates the BD slit, and the BD slit 19 is adapted to be movable along the direction in which plural light beams incident on the BD slit 19 travel.

In the third embodiment, since the BD image height is set outside the effective image region, a portion of the fθ lens through which the BD light beam passes is positioned at an end portion of the lens. When the fθ lens is fabricated, a machining error is likely to be large especially at its end portion. The focus displacement is hence liable to occur at the end portion. Further, when the fθ lens is fabricated, for example, by plastic molding, performance variation is likely to occur especially at the end portion of the lens. Hence, the focus displacement is also liable to occur at the end portion.

In the third embodiment, in the event that the above-discussed focus displacement at the BD image height occurs, the BD slit 19 is moved in the light-beam traveling direction in accordance with the amount of this focus displacement such that the displacement amount $\delta Y_{BD}$ of the image location in the main-scanning direction on the BD slit 19 can be corrected.

In the third embodiment, it is accordingly possible to effectively oppress the displacement amount of the image location in the main-scanning direction in the effective scanning region on the photosensitive drum surface 7 for image recording, thereby achieving a multi-beam optical scanning apparatus suitably usable in a high-speed and high-image-quality application.

In the third embodiment, description has been made to the construction wherein the BD slit 19 is disposed in front of the BD lens 10, but the BD slit 19 is not necessarily disposed, and the BD lens 10 can be omitted. The BD sensor 11 can be directly disposed at the location of the BD slit 19, i.e., at the image location of each light beam (this location is equivalent to the place of the photosensitive drum surface 7). In such a case, an edge of an end portion of a sensor surface of the BD sensor 11 has the same function as the BD slit 19. In such a construction, the same technical advantage can be obtained by moving the BD sensor 11 itself in the light-beam traveling direction.

The construction of this embodiment is naturally applicable to the above-described second embodiment.

(Fourth Embodiment)

Figure 20:
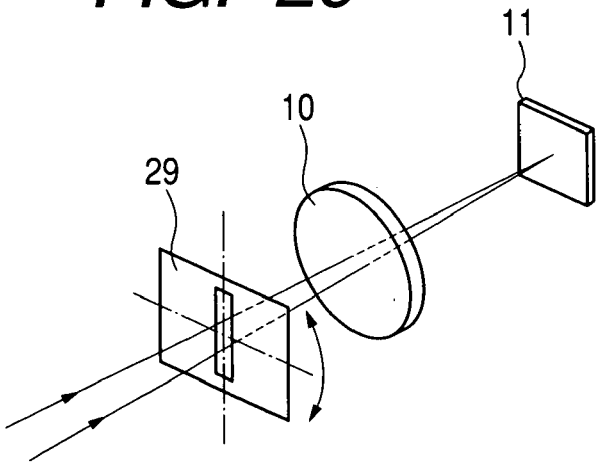
FIG. 20 is an enlarged view illustrating a writing start position synchronous signal detecting unit in a fourth embodiment according to the present invention.

FIG. 20 is an enlarged view illustrating a writing start position synchronous signal detecting unit in a multi-beam optical scanning apparatus of a fourth embodiment according to the present invention. In FIG. 20, like reference numerals designate the same elements as those illustrated in FIG. 1.

The fourth embodiment is different from the first embodiment in that a BD slit 29 is adapted to be rotatable in a section approximately perpendicular to the direction in which plural light beams incident on the BD slit 29 travel. Other structure and optical function of the fourth embodiment are approximately the same as those of the first embodiment, thereby obtaining similar technical advantages.

In FIG. 20, reference numeral 29 designates the BD slit, and the BD slit 19 is rotatable in the section approximately perpendicular to the direction in which plural light beams incident on the BD slit 29 travel.

In the fourth embodiment, in contrast to the focus displacement at the BD image height discussed in the third embodiment, the BD slit 29 is rotated in the section approximately perpendicular to the direction in which plural light beams incident on the BD slit 29 travel such that the displacement amount $\delta Y_{BD}$ of the image location in the main-scanning direction on the BD slit 29 can be corrected.

In the fourth embodiment, it is accordingly possible to effectively oppress the displacement amount of the image location in the main-scanning direction in the effective scanning region on the photosensitive drum surface 7 for image recording, thereby achieving a multi-beam optical scanning apparatus suitably usable in a high-speed and high-image-quality application.

In the fourth embodiment, description has been made to the construction wherein the BD slit 29 is disposed in front of the BD lens 10, but the BD slit 29 is not necessarily disposed, and the BD lens 10 can be omitted. The BD sensor 11 can be directly disposed at the location of the BD slit 29, i.e., at the image location of each light beam (this location is equivalent to the place of the photosensitive drum surface 7). In such a case, an edge of an end portion of a sensor surface of the BD sensor 11 has the same function as the BD slit 29. In such a construction, the same technical advantage can be obtained by rotating the BD sensor 11 itself in the section approximately perpendicular to the light-beam traveling direction.

The construction of this embodiment is also likewise applicable to the above-described second embodiment.

(Image Forming Apparatus)

Figure 21:
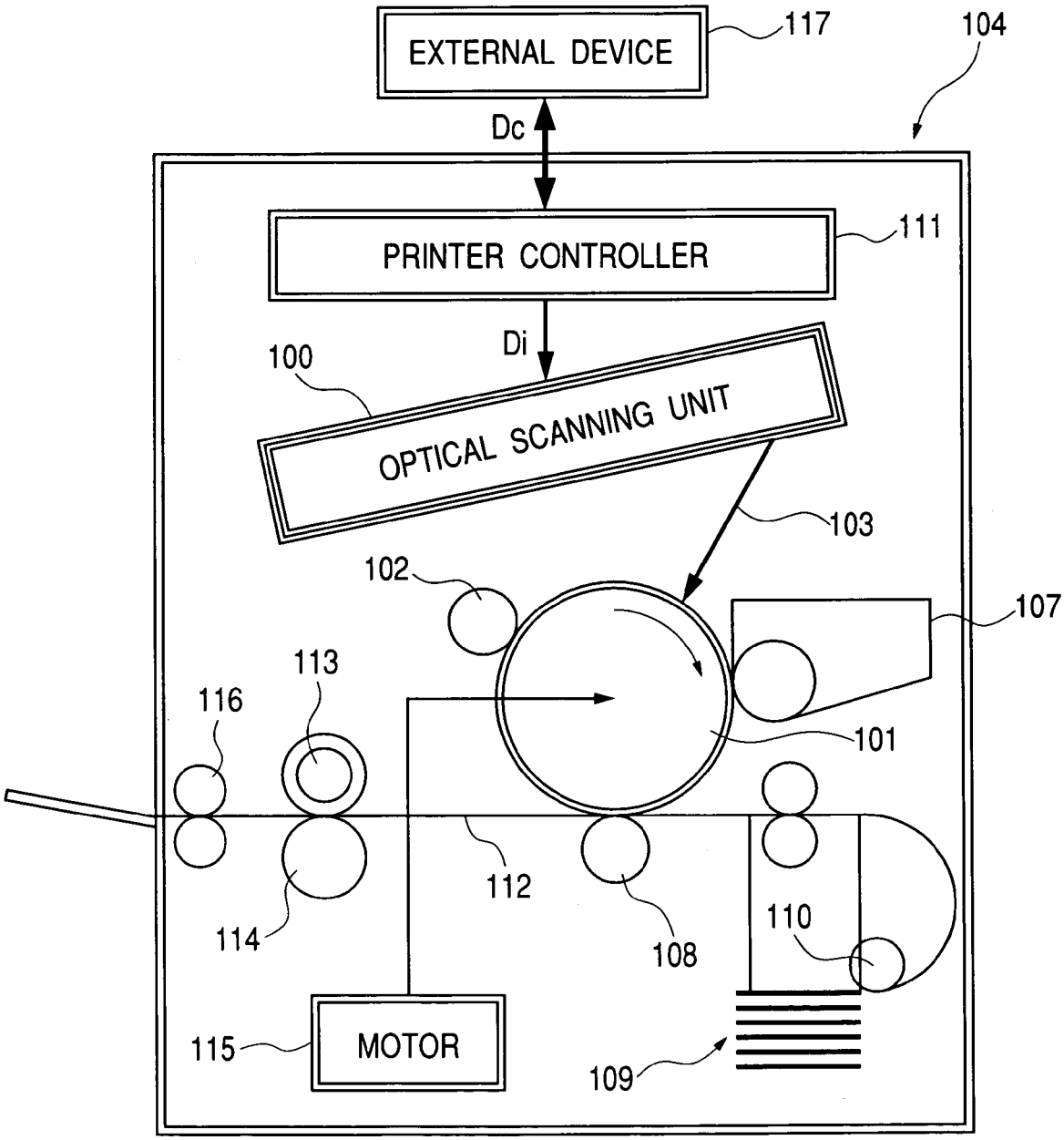
FIG. 21 is a view illustrating an embodiment of an image forming apparatus according to the present invention.

FIG. 21 is a cross-sectional view of a main portion along the sub-scanning direction illustrating an embodiment of an image forming apparatus according to the present invention. In FIG. 21, reference numeral 104 designates an image forming apparatus. This image forming apparatus 104 accepts input of code data Dc from an external equipment or apparatus 117 such as a personal computer. This code data Dc is converted into image data (dot data) Di by a printer controller 111 in the apparatus 104. This image data Di is supplied to a multi-beam optical scanning apparatus 100 having the structure as described in either of the first to fourth embodiments. This multi-beam optical scanning apparatus 100 outputs light beams 103 modulated according to the image data Di, and these light beams 103 scan a photosensitive surface of a photosensitive drum 101 in the main-scanning direction.

The photosensitive drum 101 serving as an electrostatic latent image bearing member (a photosensitive member) is rotated in a clockwise direction by a motor 115. With the rotation thereof, the photosensitive surface of the photosensitive drum 101 moves in the sub-scanning direction perpendicular to the main-scanning direction, relative to the light beams 103. Above the photosensitive drum 101, an electrostatic charging roller 102 for uniformly charging the surface of the photosensitive drum 101 is disposed so as to contact this surface. And, the surface of the photosensitive drum 101 charged by the charging roller 102 is exposed to the light beams 103 scanned by the multi-beam optical scanning apparatus 100.

As discussed previously, the light beams 103 are modulated based on the image data Di, and electrostatic latent images are formed on the surface of the photosensitive drum 101 under irradiation with the light beams 103. These electrostatic latent images are developed into toner images by a developing unit 107 disposed so as to contact the photosensitive drum 101 downstream in the rotating direction of the photosensitive drum 101 from the irradiation position of the light beams 103.

The toner image developed by the developing unit 107 is transferred onto a sheet, 112 which is a transferring material, by a transfer roller 108 disposed below the photosensitive drum 101 facing the photosensitive drum 101. Sheets 112 are stored in a sheet cassette 109 in front of the photosensitive drum 101 (on a right side of FIG. 21), but the sheet feed can also be performed by hand feeding. A sheet feed roller 110 is disposed at an end of the sheet cassette 109, and feeds each sheet 112 in the sheet cassette 109 into a conveyance path.

The sheet 112, onto which an unfixed toner image is transferred as described above, is further transferred to a fixing unit located behind the photosensitive drum 101 (i.e., on a left side of FIG. 21). The fixing unit is comprised of a fixing roller 113 having a fixing heater (not illustrated) inside and a pressing roller 114 disposed in pressure contact with the fixing roller 113, and heats the sheet 112, while pressing the sheet 112, thus conveyed from the transfer part, in a nip portion between the fixing roller 113 and the pressing roller 114, to fix the unfixed toner image on the sheet 112. Sheet discharge rollers 116 are further disposed behind the fixing roller 113 to discharge the fixed sheet 112 to the outside of the image forming apparatus 104.

Although not illustrated in FIG. 21, the print controller 111 also performs control of each section in the image forming apparatus, including the motor 115, and control of a polygon motor, etc., in the multi-beam optical scanning apparatus 104 described above, in addition to the conversion of data described above.

(Color Image Forming Apparatus)

Figure 22:
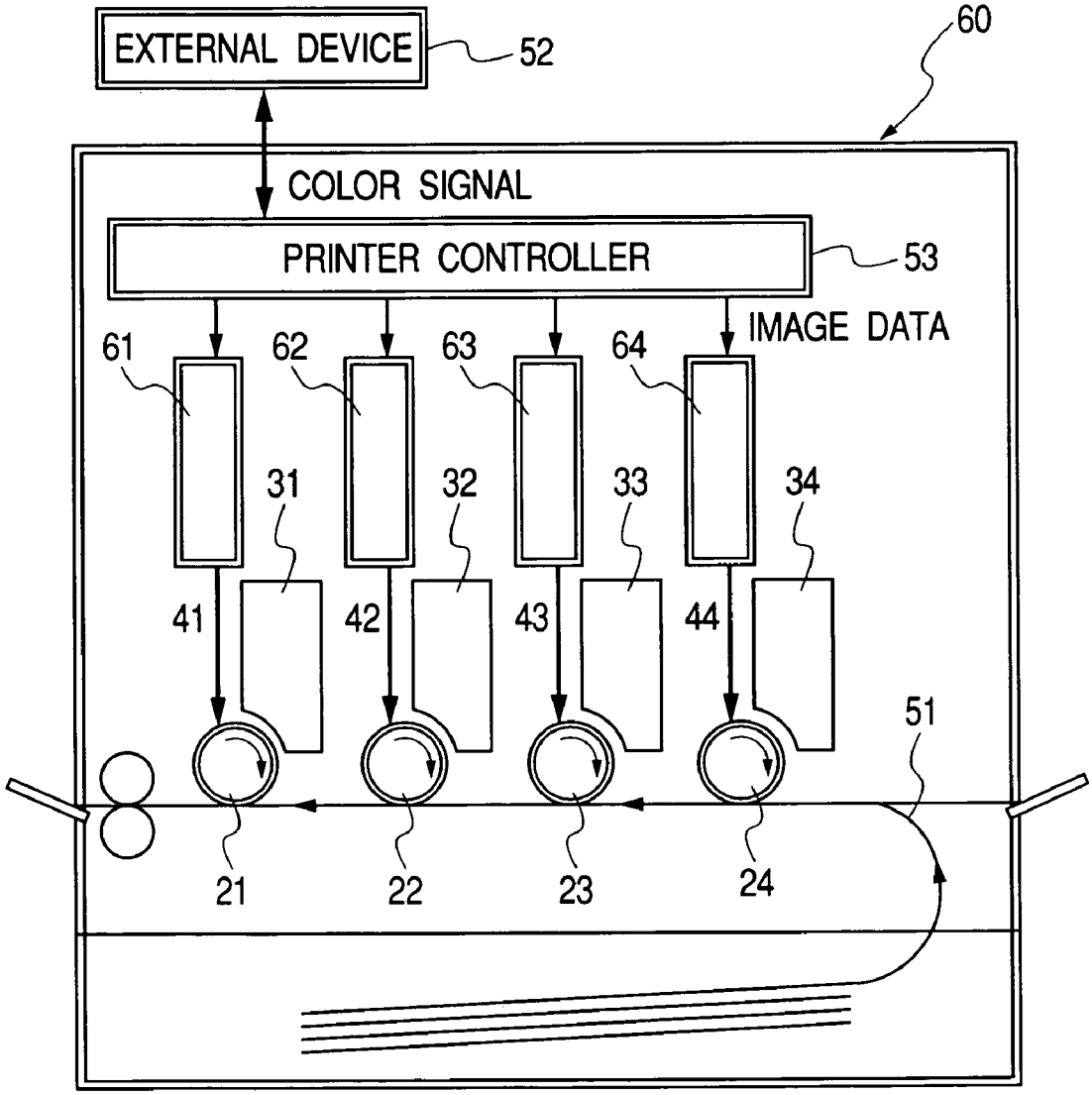
FIG. 22 is a view schematically illustrating a main portion of an embodiment of a color image forming apparatus according to the present invention.
Figure 23:
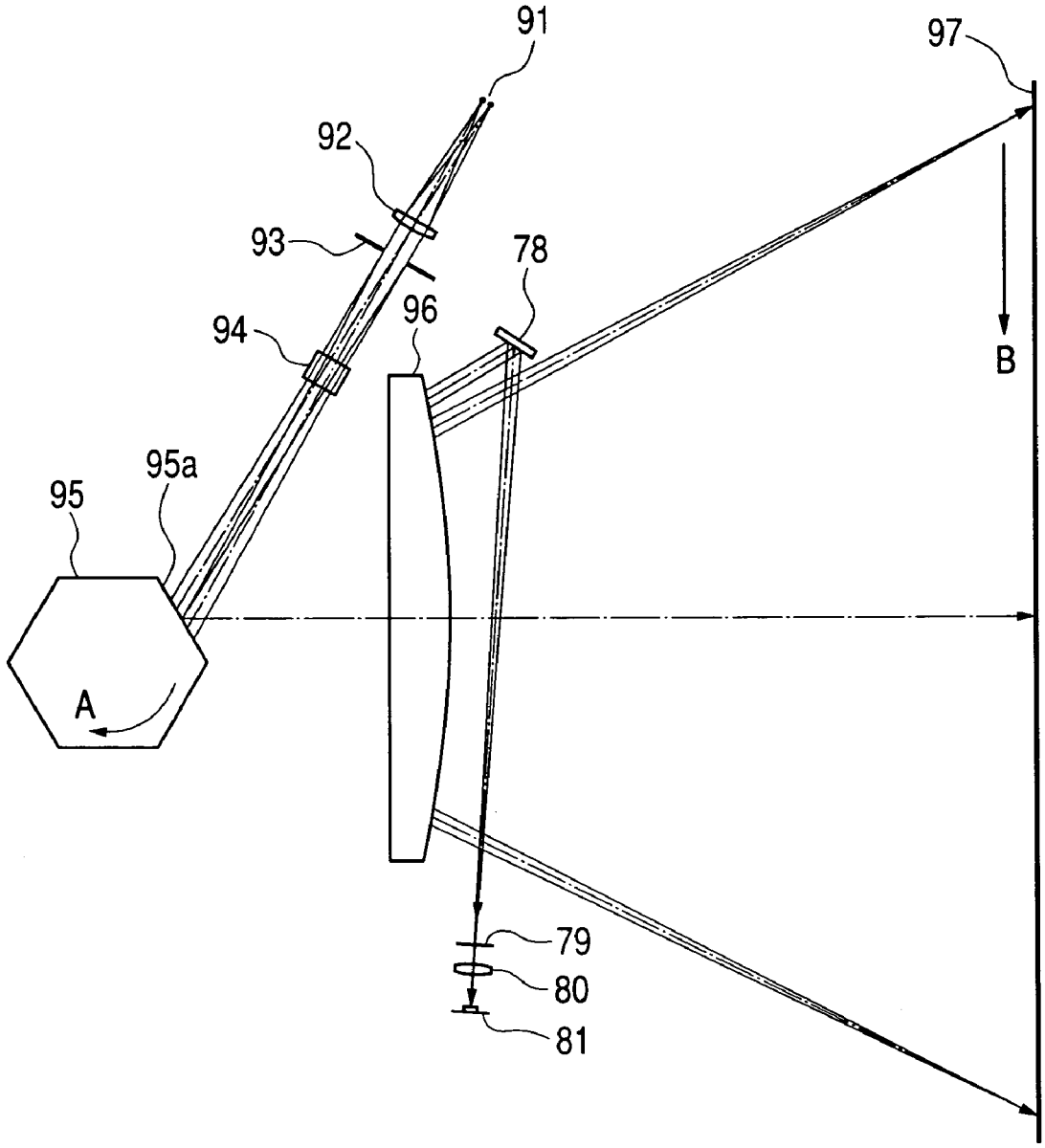
FIG. 23 is a cross-sectional view in the main-scanning section illustrating a conventional multi-beam optical scanning apparatus.
Figure 24:
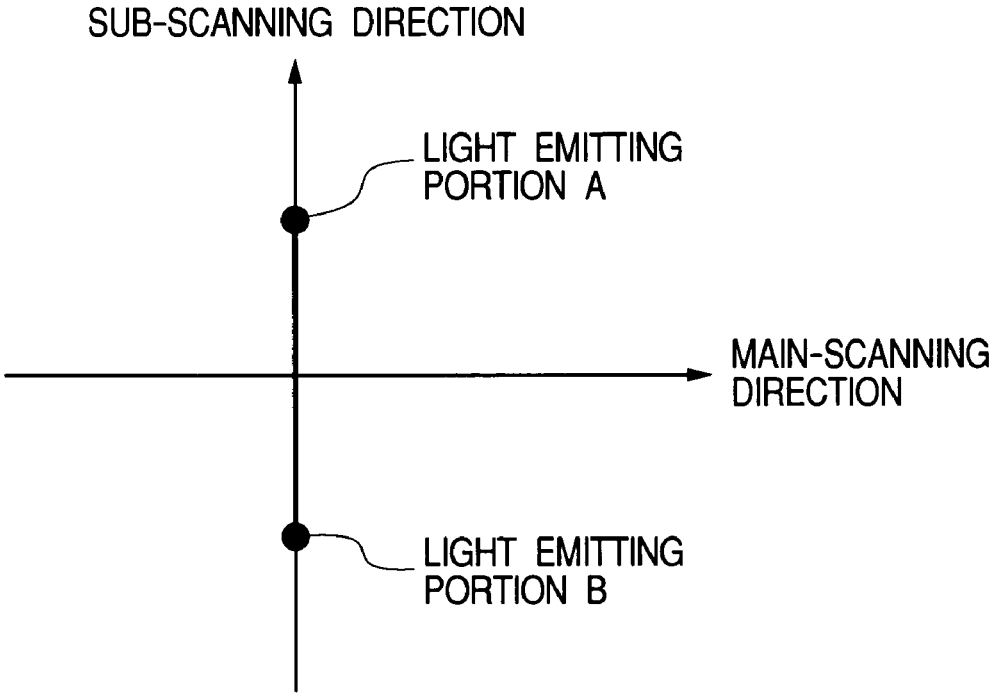
FIG. 24 is a view illustrating the arrangement of plural light sources in a conventional multi-beam optical scanning apparatus.
Figure 25:
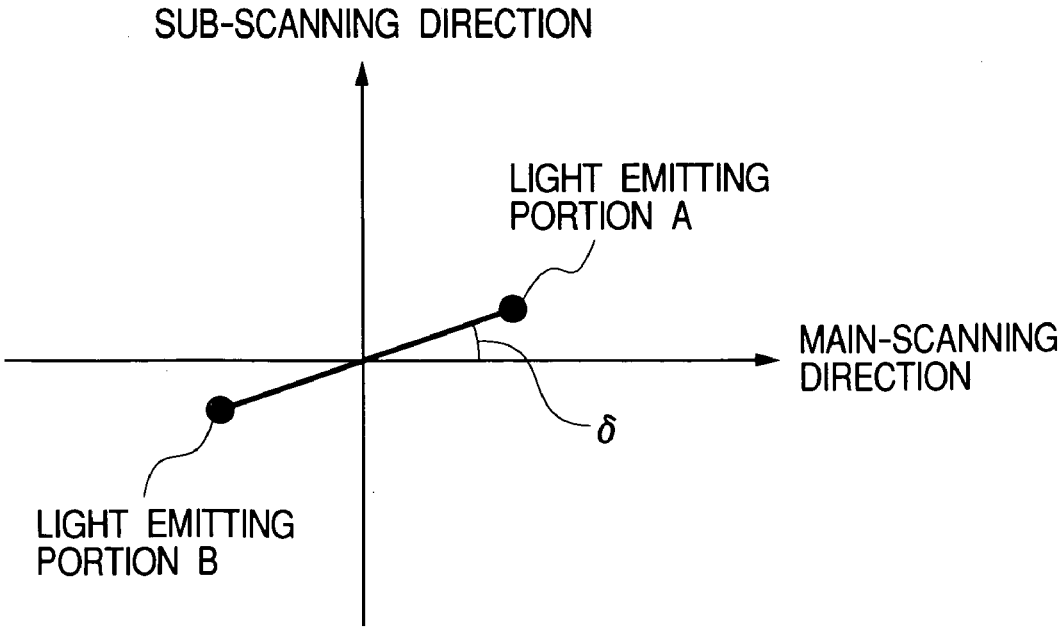
FIG. 25 is a view illustrating the arrangement of plural light sources in a conventional multi-beam optical scanning apparatus.
Figure 26:
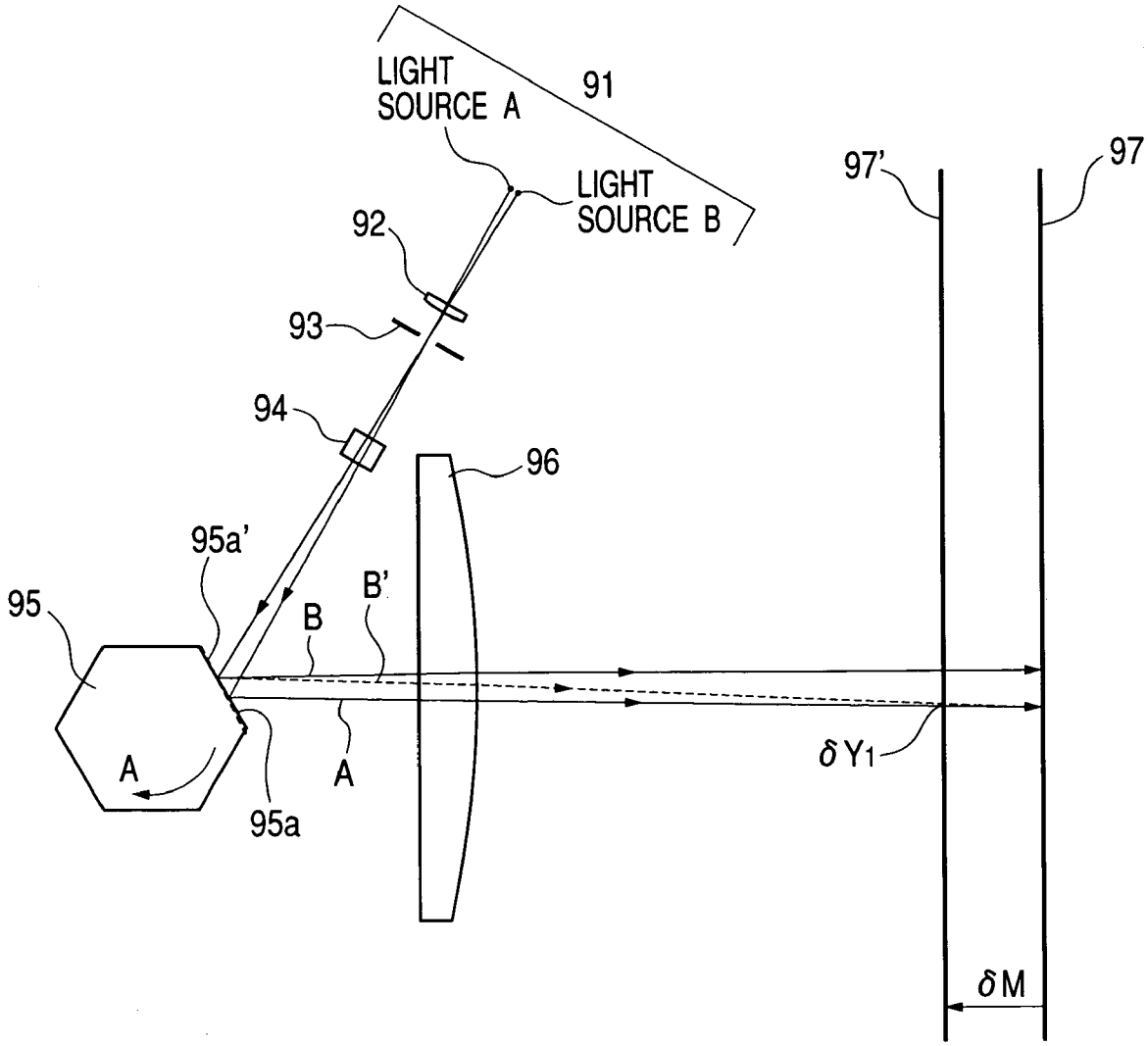
FIG. 26 is a view illustrating occurrence of a focus displacement in a conventional multi-beam optical scanning apparatus.
Figure 27:
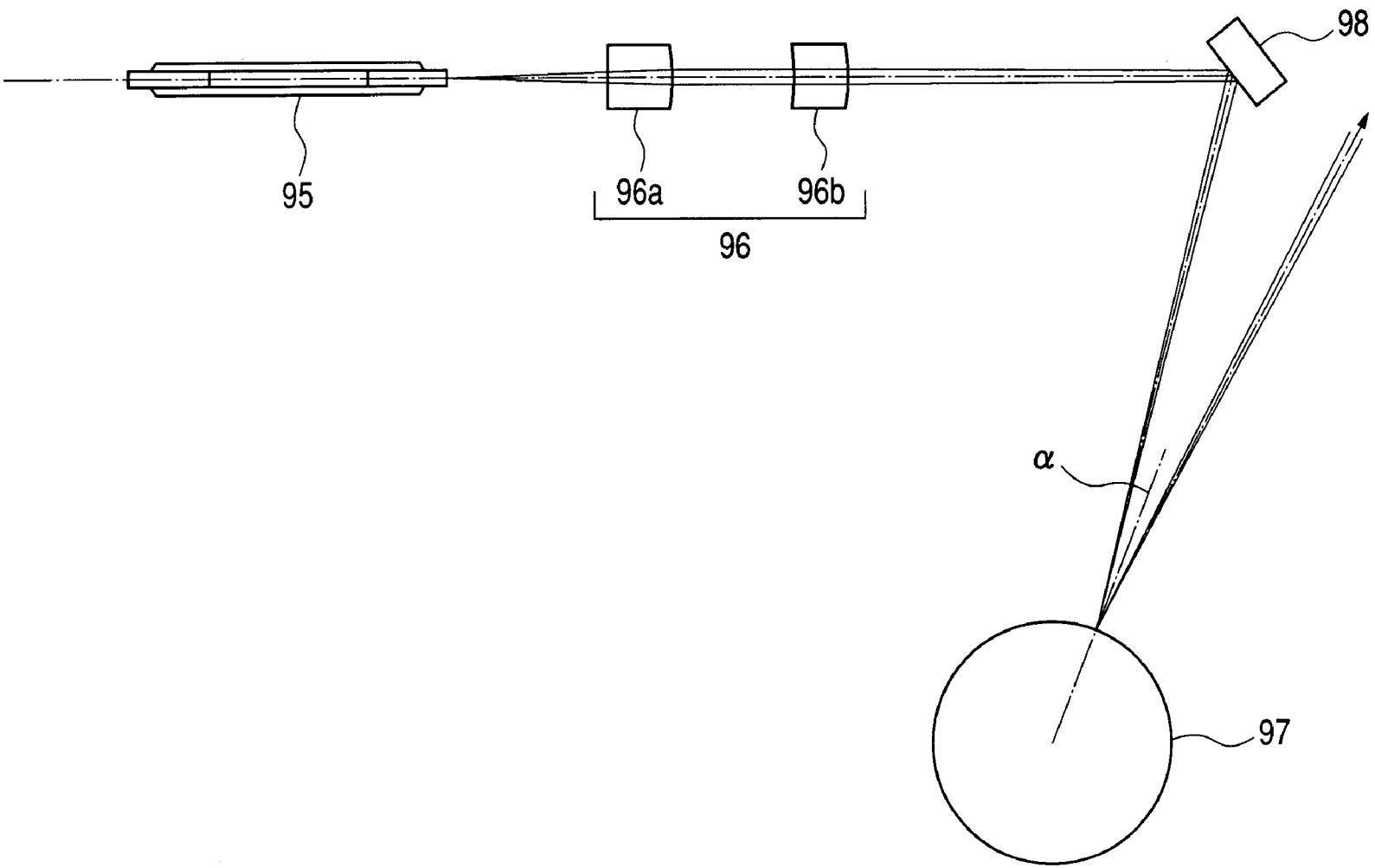
FIG. 27 is a view illustrating the relationship in the sub-scanning section between a light beam incident of a photosensitive drum and a normal to the drum.

FIG. 22 is a schematic view illustrating a main portion of an embodiment of a color image forming apparatus according to the present invention. This embodiment is directed to a color image forming apparatus of a tandem type in which four multi-beam optical scanning apparatuses are arranged in a parallel manner, and image information is recorded on each photosensitive drum serving as an image bearing member. In FIG. 22, reference numeral 60 represents a color image forming apparatus. Reference numerals 61, 62, 63 and 64 represent multi-beam optical scanning apparatuses as described in either of the above embodiments of the scanning apparatuses, respectively. Reference numerals 21, 22, 23 and 24 represent photosensitive drums each serving as the image bearing member, respectively. Reference numerals 31, 32, 33 and 34 represent developing units, respectively. Reference numeral 51 represents a conveyance belt. In the apparatus of FIG. 22, there are further arranged a transferring device (not shown) for transferring the toner image developed by the developing device to a transferring material, and a fixing device (not shown) for fixing the transferred toner image on the transferring material.

In FIG. 22, the color image forming apparatus 60 accepts input of color signals of R (red), G (green) and B (blue) from an external device 52 such as a personal computer. Those color signals are converted into image data (dot data) of C (cyan), M (magenta), Y (yellow), and B (black) by a printer controller 53 in the apparatus. The image data is supplied to the multi-beam optical scanning apparatuses 61, 62, 63 and 64, respectively. Those multi-beam optical scanning apparatuses 61, 62, 63 and 64 output a plurality of light beams 41, 42, 43 or 44 modulated according to image data, and these light beams scan photosensitive surfaces of photosensitive drums 21, 22, 23 and 24 in the main-scanning direction, respectively.

In the color image forming apparatus of this embodiment, there are provided four multi-beam optical scanning apparatuses 61, 62, 63 and 64 corresponding to colors of C (cyan), M (magenta), Y (yellow), and B (black), respectively, and these optical scanning apparatuses record image signals (image data) on the photosensitive drums 21, 22, 23 and 24 in a parallel manner, respectively, to speedily print a color image.

In the color image forming apparatus of this embodiment, latent images of colors are formed on corresponding photosensitive drums 21, 22, 23 and 24 using light beams based on the image data by the four multi-beam optical scanning apparatuses 11, 12, 13 and 14, respectively. After that, the latent images are multi-transferred onto a recording material, and a full-color picture is thus formed.

As the external device 52, a color image reading apparatus provided with a CCD sensor can be used, for example. In this case, this color image reading apparatus and the color image forming apparatus 60 constitute a color digital copying apparatus.

According to the present invention, values of the individual elements are appropriately designed such that the condition of formula (6) or (11) can be satisfied, and it is accordingly possible to effectively reduce displacements or variations of the image locations of plural light beams emitted from the light source unit with plural light emitting portions, without any sophisticated adjustment. It is therefore possible to provide a multi-beam optical scanning apparatus suitably usable in a high-speed and high-image-quality apparatus, and an image forming apparatus using this multi-beam optical scanning apparatus.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A multi-beam optical scanning apparatus comprising:

a light source unit having at least three light emitting portions disposed with being spaced from each other in a main-scanning direction;

a first optical system for changing conditions of at least three divergent light beams emitted from the light source unit;

a stop for restricting widths of the at least three light beams transmitted through the first optical system at least in the main-scanning direction;

a deflecting unit for reflecting the at least three light beams transmitted through the stop;

a second optical system for forming images of the at least three light beams reflected by the deflecting unit on a surface to be scanned; and a detecting unit for detecting a writing start position synchronous signal for controlling timing of a scanning start position on the surface to be scanned, the writing start position synchronous signal detecting unit including a detecting device for detecting the writing start position synchronous signal, and a slit member disposed in an optical path between the writing start position synchronous signal detecting device and the deflecting unit, and the writing start position synchronous signal detecting unit being adapted to control the timing of the scanning start position on the surface to be scanned by using a light beam reflected by the deflecting unit and transmitted through the slit member;

wherein a condition given by $$\left|P\sin\alpha\tan\beta + \frac{S_1 L_1}{f_1 f_2}(\delta M_{(\beta)} - \delta M_{(BD)})\right| \leq \frac{25.4}{3N_M}$$

is satisfied, where Si is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $\alpha$ is an average of angles formed between principal rays of the at least three light beams incident on the surface to be scanned and a normal to the surface to be scanned in a sub-scanning section, $\beta$ is an average of angles formed between the principal rays of the at least three light beams incident at any scanning location on the surface to be scanned and the normal to the surface to be scanned in a main-scanning section, $\delta M_{(\beta)}$ is the main-scanning focus displacement amount at the scanning location of the average $\beta$, $\delta M_{(BD)}$ is the main-scanning focus displacement amount at a scanning location whereat the at least three light beams pass through the slit member, $N_M$ is the number of pixels per inch in the main-scanning direction which is determined from a resolution in the main-scanning direction on the surface to be scanned, and P is the spacing in the sub-scanning direction between image spots of light beams emitted from light emitting portions at opposite ends in the at least three light emitting portions on the surface to be scanned.

2. A multi-beam optical scanning apparatus according to claim 1, wherein the writing start position synchronous signal detecting unit is adapted to control the timing of the scanning start position on the surface to be scanned by using all of the at least three light beams reflected by the deflecting unit.

3. A multi-beam optical scanning apparatus according to claim 1, wherein the slit member is adapted to be movable in a direction in which the at least three light beams incident on the slit member travel.

4. A multi-beam optical scanning apparatus according to claim 1, wherein the slit member is adapted to be rotatable in a section approximately perpendicular to the direction in which the at least three light beams incident on the slit member travel.

5. A multi-beam optical scanning apparatus according to claim 1, wherein a light beam reflected by the deflecting unit and incident on the writing start position synchronous signal detecting device is adapted to pass through the second optical system.

6. A multi-beam optical scanning apparatus comprising:

a light source unit having at least three light emitting portions disposed with being spaced from each other in a main-scanning direction;

a first optical system for changing conditions of at least three divergent light beams emitted from the light source unit;

a stop for restricting widths of the at least three light beams transmitted through the first optical system at least in the main-scanning direction;

a deflecting unit for reflecting the at least three light beams transmitted through the stop;

a second optical system for forming images of the at least three light beams reflected by the deflecting unit on a surface to be scanned; and a detecting unit for detecting a writing start position synchronous signal for controlling timing of a scanning start position on the surface to be scanned, the writing start position synchronous signal detecting unit including a third optical system disposed independently from the second optical system, a detecting device for detecting the writing start position synchronous signal, and a slit member disposed in an optical path between the writing start position synchronous signal detecting device and the third optical system unit, and the writing start position synchronous signal detecting unit being adapted to control the timing of the scanning start position on the surface to be scanned by using a light beam reflected by the deflecting unit;

wherein a condition given by $$\left|P\sin\alpha\tan\beta+\frac{S_1L_1}{f_1f_2}\delta M_{(\beta)}-\frac{S_1L_1}{f_1f_3}\delta M_{(BD)}\right|\leq\frac{25.4}{3N_M}$$

is satisfied, where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $f_3$ is the focal length of the third optical system in the main-scanning direction, $\alpha$ is an average of angles formed between principal rays of the at least three light beams incident on the surface to be scanned and a normal to the surface to be scanned in a sub-scanning section, $\beta$ is an average of angles formed between the principal rays of the at least three light beams incident at any scanning location on the surface to be scanned and the normal to the surface to be scanned in a main-scanning section, $\delta M_{(\beta)}$ is the main-scanning focus displacement amount at the scanning location of the average $\beta$, $\delta M_{(BD)}$ is the main-scanning focus displacement amount at a scanning location whereat the at least three light beams pass through the slit member, $N_M$ is the number of pixels per inch in the main-scanning direction which is determined from a resolution in the main-scanning direction on the surface to be scanned, and P is the spacing in the sub-scanning direction between image spots of light beams emitted from light emitting portions at opposite ends in the at least three light emitting portions on the surface to be scanned.

7. A multi-beam optical scanning apparatus according to claim 6, wherein the writing start position synchronous signal detecting unit is adapted to control the timing of the scanning start position on the surface to be scanned by using all of the at least three light beams reflected by the deflecting unit.

8. A multi-beam optical scanning apparatus according to claim 6, wherein the slit member is adapted to be movable in a direction in which the at least three light beams incident on the slit member travel.

9. A multi-beam optical scanning apparatus according to claim 6, wherein the slit member is adapted to be rotatable in a section approximately perpendicular to the direction in which the at least three light beams incident on the slit member travel.

10. An image forming apparatus comprising:

a multi-beam optical scanning apparatus recited in any one of claims 1 to 5;

a photosensitive member disposed on the surface to be scanned;

a developing device for developing as a toner image an electrostatic latent image formed on the photosensitive member by the light beams scanned by the multi-beam optical scanning apparatus;

a transferring device for transferring the developed toner image onto a transferring material; and a fixing device for fixing the transferred toner image to the transferring material.

11. An image forming apparatus comprising:

a multi-beam optical scanning apparatus recited in any one of claims 1 to 5; and a printer controller for converting code data input from an external equipment into an image signal, and inputting the image signal into the multi-beam optical scanning apparatus.

12. A color image forming apparatus comprising:

multi-beam optical scanning apparatuses recited in any one of claims 1 to 5; and a plurality of image bearing members each of which is disposed on the surface to be scanned of each of the multi-beam optical scanning apparatuses, and on which different color images are formed, respectively.

13. A color image forming apparatus according to claim 12, further comprising a printer controller for converting color signals input from an external equipment into image data of different colors, and inputting the image data into the multi-beam optical scanning apparatuses, respectively.

14. A multi-beam optical scanning apparatus comprising:

a light source unit having at least three light emitting portions disposed with being spaced from each other in a main-scanning direction;

a first optical system for changing conditions of at least three divergent light beams emitted from the light source unit;

a stop for restricting widths of the at least three light beams transmitted through the first optical system at least in the main-scanning direction;

a deflecting unit for reflecting the at least three light beams transmitted through the stop;

a second optical system for forming images of the at least three light beams reflected by the deflecting unit on a surface to be scanned; and a detecting unit for detecting a writing start position synchronous signal for controlling timing of a scanning start position on the surface to be scanned, the writing start position synchronous signal detecting unit including a detecting device for detecting the writing start position synchronous signal;

wherein a condition given by $$\left|P\sin\alpha\tan\beta+\frac{S_1L_1}{f_1f_2}(\delta M_{(\beta)}-\delta M_{(BD)})\right|\leq\frac{25.4}{3N_M}$$

is satisfied, where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $\alpha$ is an average of angles formed between principal rays of the at least three light beams incident on the surface to be scanned and a normal to the surface to be scanned in a sub-scanning section, $\beta$ is an average of angles formed between the principal rays of the at least three light beams incident at any scanning location on the surface to be scanned and the normal to the surface to be scanned in a main-scanning section, $\delta M_{(\beta)}$ is the main-scanning focus displacement amount at the scanning location of the average $\beta$, $\delta M_{(BD)}$ is the main-scanning focus displacement amount at a light receiving surface whereat the writing start position synchronous signal detecting device receives the at least three light beams, $N_M$ is the number of pixels per inch in the main-scanning direction which is determined from a resolution in the main-scanning direction on the surface to be scanned, and P is the spacing in the sub-scanning direction between image spots of light beams emitted from light emitting portions at opposite ends in the at least three light emitting portions on the surface to be scanned.

15. A multi-beam optical scanning apparatus according to claim 14, wherein the writing start position synchronous signal detecting unit is adapted to control the timing of the scanning start position on the surface to be scanned by using all of the at least three light beams reflected by the deflecting unit.

16. A multi-beam optical scanning apparatus according to claim 14, wherein a light beam reflected by the deflecting unit and incident on the writing start position synchronous signal detecting device is adapted to pass through the second optical system.

17. A multi-beam optical scanning apparatus comprising:

a light source unit having at least three light emitting portions disposed with being spaced from each other in a main-scanning direction;

a first optical system for changing conditions of at least three divergent light beams emitted from the light source unit;

a stop for restricting widths of the at least three light beams transmitted through the first optical system at least in the main-scanning direction;

a deflecting unit for reflecting the at least three light beams transmitted through the stop;

a second optical system for forming images of the at least three light beams reflected by the deflecting unit on a surface to be scanned; and a detecting unit for detecting a writing start position synchronous signal for controlling timing of a scanning start position on the surface to be scanned, the writing start position synchronous signal detecting unit including a third optical system disposed independently from the second optical system, and a detecting device for detecting the writing start position synchronous signal;

wherein a condition given by $$\left|P\sin\alpha\tan\beta+\frac{S_1L_1}{f_1f_2}\delta M_{(\beta)}-\frac{S_1L_1}{f_1f_3}\delta M_{(BD)}\right|\leq\frac{25.4}{3N_M}$$

is satisfied, where $S_1$ is the spacing in the main-scanning direction between light emitting portions at opposite ends in the at least three light emitting portions, $f_1$ is the focal length of the first optical system, $L_1$ is the distance between the stop and a deflecting facet of the deflecting unit, $f_2$ is the focal length of the second optical system in the main-scanning direction, $f_3$ is the focal length of the third optical system in the main-scanning direction, $\alpha$ is an average of angles formed between principal rays of the at least three light beams incident on the surface to be scanned and a normal to the surface to be scanned in a sub-scanning section, $\beta$ is an average of angles formed between the principal rays of the at least three light beams incident at any scanning location on the surface to be scanned and the normal to the surface to be scanned in a main-scanning section, $\delta M_{(\beta)}$ is the main-scanning focus displacement amount at the scanning location of the average $\beta$, $\delta M_{(BD)}$ is the main-scanning focus displacement amount at a light receiving surface whereat the writing start position synchronous signal detecting device receives the at least three light beams, $N_M$ is the number of pixels per inch in the main-scanning direction which is determined from a resolution in the main-scanning direction on the surface to be scanned, and P is the spacing in the sub-scanning direction between image spots of light beams emitted from light emitting portions at opposite ends in the at least three light emitting portions on the surface to be scanned.

18. A multi-beam optical scanning apparatus according to claim 17, wherein the writing start position synchronous signal detecting unit is adapted to control the timing of the scanning start position on the surface to be scanned by using all of the at least three light beams reflected by the deflecting unit.

19. An image forming apparatus comprising:

a multi-beam optical scanning apparatus recited in any one of claims 14 to 16;

a photosensitive member disposed on the surface to be scanned;

a developing device for developing as a toner image an electrostatic latent image formed on the photosensitive member by the light beams scanned by the multi-beam optical scanning apparatus;

a transferring device for transferring the developed toner image onto a transferring material; and a fixing device for fixing the transferred toner image to the transferring material.

20. An image forming apparatus comprising:

a multi-beam optical scanning apparatus recited in claim 19; and a printer controller for converting code data input from an external equipment into an image signal, and inputting the image signal into the multi-beam optical scanning apparatus.

21. A color image forming apparatus comprising:

multi-beam optical scanning apparatuses recited in any one of claims 14 to 16; and a plurality of image bearing members each of which is disposed on the surface to be scanned of each of the multi-beam optical scanning apparatuses, and on which different color images are formed, respectively.

22. A color image forming apparatus according to claim 21, further comprising a printer controller for converting color signals input from an external equipment into image data of different colors, and inputting the image data into the multi-beam optical scanning apparatuses, respectively.

* * * * *

UNITED STATES PATENT AND TRADEMARK OFFICE

CERTIFICATE OF CORRECTION

PATENT NO. : 7,119,824 B2
APPLICATION NO. : 10/809445
DATED : October 10, 2006
INVENTOR(S) : Yoshihiro Ishibe It is certified that error appears in the above-identified patent and that said Letters Patent is hereby corrected as shown below:

COLUMN 7

Line 33, " $\beta M_{(\beta)}$" should read --$\delta M_{(\beta)}$--; and
Line 67, "synchro" should read --synchro- --.

COLUMN 15

Lines 61-64, the equation should read:

$$-- \ \delta Y_{BD}' = \frac{S_1 L_2}{f_1 f_2} \delta M_{(BD)} \ --.$$

COLUMN 21

Line 65, "a." should read --α.--

COLUMN 24

Line 1, "slit 9," should read --slit 14,--;
Line 4 ,"slit 9" should read --slit 14--; and
Line 39, "slit 9." should read --slit 14.--.

COLUMN 30

Line 53, "slit 19" should read --slit 29--.

COLUMN 33

Line 65, "$S_i$" should read --$S_1$--.

COLUMN 35

Line 55, "claims 1 to 5" should read --claims 1 to 9--.

COLUMN 36

Line 2, "claims 1 to 5" should read --claims 1 to 9--; and
Line 9, "claims 1 to 5" should read --claims 1 to 9--.

UNITED STATES PATENT AND TRADEMARK OFFICE

CERTIFICATE OF CORRECTION

PATENT NO. : 7,119,824 B2
APPLICATION NO. : 10/809445
DATED : October 10, 2006
INVENTOR(S) : Yoshihiro Ishibe It is certified that error appears in the above-identified patent and that said Letters Patent is hereby corrected as shown below:

COLUMN 38

Line 24, "claims 14 to 16" should read --claims 14 to 18--; and
Line 44 "claims 14 to 16" should read --claims 14 to 18--.

Signed and Sealed this

Twenty-ninth Day of May, 2007

JON W. DUDAS
*Director of the United States Patent and Trademark Office*